US008353756B2

(12) United States Patent
Walker et al.

(10) Patent No.: US 8,353,756 B2
(45) **Date of Patent: *Jan. 15, 2013**

(54) METHOD AND APPARATUS FOR SETTING GAME PARAMETERS

(75) Inventors: Jay S. Walker, Ridgefield, CT (US); James A. Jorasch, Stamford, CT (US); Victor M. Garcia, New Haven, CT (US); Geoffrey M. Gelman, Stamford, CT (US); Daniel E. Tedesco, Huntington, CT (US); Steven M. Santisi, Ridgefield, CT (US)

(73) Assignee: IGT, Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/299,015

(22) Filed: Nov. 17, 2011
(Under 37 CFR 1.47)

(65) Prior Publication Data

US 2012/0064963 A1 Mar. 15, 2012

Related U.S. Application Data

(60) Continuation of application No. 11/556,399, filed on Nov. 3, 2006, now Pat. No. 8,075,390, which is a division of application No. 10/784,845, filed on Feb. 23, 2004, now Pat. No. 7,427,233.

(60) Provisional application No. 60/449,270, filed on Feb. 21, 2003.

(51) Int. Cl.
*A63F 9/24* (2006.01)

(52) U.S. Cl. ..... 463/20

(58) Field of Classification Search ..... 463/16, 463/20

See application file for complete search history.

(56) References Cited

U.S. PATENT DOCUMENTS

| | | | |
|---|---|---|---|
| 4,184,683 | A | 1/1980 | Hooker |
| 4,448,419 | A | 5/1984 | Telnaes |
| 4,570,934 | A | 2/1986 | Smyth |
| 4,669,731 | A | 6/1987 | Clarke |
| 4,679,143 | A | 7/1987 | Hagiwara |
| 4,695,053 | A | 9/1987 | Vazquez, Jr. |
| 4,760,245 | A | 7/1988 | Fukaya |

(Continued)

FOREIGN PATENT DOCUMENTS

| | | |
|---|---|---|
| AU | 200075787 | 4/2001 |

(Continued)

OTHER PUBLICATIONS

Schneier, Applied Cryptography 2e, Chapter 2, 27 pages, published in 1996.

(Continued)

*Primary Examiner* — Corbett B Coburn

(74) *Attorney, Agent, or Firm* — Neal, Gerber & Eisenberg LLP

(57) ABSTRACT

The present invention allows gaming devices to set or modify game parameters through the use of random events such as spinning slot machine reels or random number generators. In some embodiments, game parameters may be established with various initial values, and then, by spinning the gaming devices' reels, for example, random reel values lining up on the payline may be used as new game parameter values. Parameter values may be used to control or initialize almost any aspect of the gaming device play experience, ranging from the types of symbols seen on the reels, to the appearance or behavior of game characters, to the rate at which "complementary" points are awarded.

24 Claims, 29 Drawing Sheets

U.S. PATENT DOCUMENTS 4,856,787 A 8/1989 Itkis
4,939,705 A 7/1990 Hamilton
4,991,848 A 2/1991 Greenwood
5,083,271 A 1/1992 Thacher
5,108,099 A 4/1992 Smyth
5,123,649 A 6/1992 Tiberio
5,178,390 A 1/1993 Okada
5,179,517 A 1/1993 Sarbin
5,242,163 A 9/1993 Fulton
5,259,616 A 11/1993 Bergmann
5,275,400 A 1/1994 Weingardt
5,277,424 A 1/1994 Wilms
5,342,047 A 8/1994 Heidel
5,356,140 A 10/1994 Dabrowski
5,370,399 A 12/1994 Liverance
5,393,057 A 2/1995 Marnell, II
5,393,061 A 2/1995 Manship
5,401,023 A 3/1995 Wood
5,409,225 A 4/1995 Kelly
5,449,173 A 9/1995 Thomas
5,494,287 A 2/1996 Manz
5,511,784 A 4/1996 Furry
5,544,892 A 8/1996 Breeding
5,559,312 A 9/1996 Lucero
5,564,700 A 10/1996 Celona
5,580,308 A 12/1996 Nakamura
5,580,309 A 12/1996 Piechowiak
5,586,766 A 12/1996 Forte
5,603,502 A 2/1997 Nakagawa
5,611,730 A 3/1997 Weiss
5,639,088 A 6/1997 Schneider
5,655,961 A 8/1997 Acres
5,664,998 A 9/1997 Seelig
5,695,400 A 12/1997 Fennell
5,695,402 A 12/1997 Stupak
5,697,843 A 12/1997 Manship
5,702,304 A 12/1997 Acres
5,704,835 A 1/1998 Dietz
5,720,662 A 2/1998 Holmes, Jr.
5,722,891 A 3/1998 Inoue
5,741,183 A 4/1998 Acres
5,755,621 A 5/1998 Marks
5,761,647 A 6/1998 Boushy
5,770,533 A 6/1998 Franchi
5,800,264 A 9/1998 Pascal
5,811,772 A 9/1998 Lucero
5,823,879 A 10/1998 Goldberg
5,833,537 A 11/1998 Barrie
5,833,538 A 11/1998 Weiss
5,833,540 A 11/1998 Miodunski
5,836,586 A 11/1998 Marks
5,848,932 A 12/1998 Adams
5,851,147 A 12/1998 Stupak
5,882,260 A 3/1999 Marks
5,882,261 A * 3/1999 Adams ..... 463/20
5,910,048 A 6/1999 Feinberg
5,979,702 A 11/1999 Hennessey
5,980,384 A 11/1999 Barrie
5,997,400 A 12/1999 Seelig
5,997,401 A 12/1999 Crawford
6,004,207 A 12/1999 Wilson
6,015,344 A 1/2000 Kelly
6,019,374 A 2/2000 Breeding
6,033,307 A 3/2000 Vancura
6,039,648 A 3/2000 Guinn
6,053,813 A 4/2000 Mathis
6,068,552 A 5/2000 Walker
6,077,162 A 6/2000 Weiss
6,077,163 A 6/2000 Walker
6,089,975 A 7/2000 Dunn
6,093,100 A 7/2000 Singer
6,110,043 A 8/2000 Olsen
6,113,102 A 9/2000 Marks
6,117,009 A 9/2000 Yoseloff
6,135,882 A 10/2000 Kadlic
6,142,872 A 11/2000 Walker
6,165,071 A 12/2000 Weiss
6,203,430 B1 3/2001 Walker
6,264,560 B1 7/2001 Goldberg
6,270,409 B1 8/2001 Shuster
6,270,412 B1 8/2001 Crawford
6,287,202 B1 9/2001 Pascal
6,302,790 B1 10/2001 Brossard
6,312,332 B1 11/2001 Walker
6,364,765 B1 4/2002 Walker
6,375,187 B1 4/2002 Baerlocher
6,394,902 B1 5/2002 Glavich et al.
6,439,995 B1 8/2002 Hughs-Baird et al.
6,471,589 B1 10/2002 Nagano
6,520,856 B1 2/2003 Walker
6,606,602 B1 8/2003 Kolls
6,767,283 B1 7/2004 Weiss
6,843,724 B2 1/2005 Walker
6,986,709 B2 1/2006 Hughs-Baird et al.
2002/0042294 A1 4/2002 Pau
2004/0072613 A1 4/2004 Visoenik
2004/0162134 A1 8/2004 Walker

FOREIGN PATENT DOCUMENTS

GB 2098778 11/1982
GB 2161008 1/1986
JP 2001-314587 A 11/2001
WO WO 96.08295 3/1996
WO WO 98/19280 5/1998

OTHER PUBLICATIONS

Notice of Allowability for U.S. Appl. No. 09/164,473 dated Aug. 28, 2000, 1pp.
Office Action for U.S. Appl. No. 09/164,473 dated Jan. 18, 2001, 3pp.
Notice of Allowance for U.S. Appl. No. 09/052,291 dated Dec. 9, 1999, 4pp.
Notice of Allowance for U.S. Appl. No. 10/784,845 dated Dec. 11, 2007, 2pp.
Office Action re Petition Decision for U.S. Appl. No. 10/784,845 dated Mar. 2, 2007, 7pp.
Office Action for U.S. Appl. No. 10/784,845 dated Jul. 14, 2006, 4pp.
Office Action for U.S. Appl. No. 10/784,845 dated Apr. 27, 2006,10pp.
Office Action re Petition Decision for U.S. Appl. No. 10/784,845 dated Dec. 10, 2007, 5pp.
Office Action for U.S. Appl. No. 10/784,845 dated Apr. 7, 2005, 8pp.
Restriction for U.S. Appl. No. 10/784,845 dated Dec. 17, 2004, 4pp.
Office Action for U.S. Appl. No. 10/772,837 dated Sep. 13, 2007, 7pp.
Office Action for U.S. Appl. No. 10/778,576 dated Mar. 6, 2007, 2pp.
Office Action for U.S. Appl. No. 10/778,576 dated Jul. 20, 2005, 8pp.
Office Action for U.S. Appl. No. 11/456,255 dated Nov. 23, 2007, 5pp.
Office Action for U.S. Appl. No. 09/716,918 dated Jan. 8, 2008, 8pp.
Office Action for U.S. Appl. No. 09/716,918 dated May 8, 2007, 2pp.
Office Action for U.S. Appl. No. 09/716,918 dated Dec. 8, 2006, 11pp.
Office Action for U.S. Appl. No. 09/716,918 dated Jul. 20, 2005, 10pp.
Office Action for U.S. Appl. No. 09/716,918 dated Oct. 1, 2004, 7pp.
Office Action for U.S. Appl. No. 09/716,918 dated Oct. 1, 2004 9pp.
Office Action for U.S. Appl. No. 09/716,918 dated Feb. 24, 2004, 6pp.
Office Action for U.S. Appl. No. 09/716,918 dated May 20, 2003, 4pp.
Office Action for U.S. Appl. No. 09/716,918 dated May 3, 2002, 4pp.
Decision on Petition for U.S. Appl. No. 09/716,918 dated Apr. 29, 2003, 1pp.
Notice of Non-Compliant Appeal Brief for U.S. Appl. No. 09/716,918 dated Oct. 3, 2007, 2pp.
Notice of Allowance for U.S. Appl. No. 10/752,068 dated Sep. 22, 2004, 5pp.
Office Action for U.S. Appl. No. 10/361,201 dated Jan. 28, 2008, 6pp.
Office Action for U.S. Appl. No. 10/361,201 dated Jun. 22, 2007, 7pp.
Office Action for U.S. Appl. No. 10/361,201 dated Dec. 12, 2006, 8pp.

Office Action for U.S. Appl. No. 09/108,646 dated Sep. 13, 2001, 2pp.
Notice of Allowability for U.S. Appl. No. 09/108,646 dated Nov. 28, 2001, 5pp.
Office Action for U.S. Appl. No. 09/108,646 dated Jun. 18, 2001, 6pp.
Office Action for U.S. Appl. No. 09/108,646 dated Dec. 29, 2000, 5pp.
Office Action for U.S. Appl. No. 09/108,646 dated May 10, 2000, 5pp.
Office Action for U.S. Appl. No. 09/108,646 dated Jan. 7, 2000, 5pp.
Notice of Allowance for U.S. Appl. No. 10/029,143 dated Sep. 25, 2003, 3pp.
Office Action for U.S. Appl. No. 10/029,143 dated Sep. 4, 2003, 2pp.
Office Action for U.S. Appl. No. 10/029,143 dated Mar. 28, 2003, 7pp.
Office Action for U.S. Appl. No. 09/164,473 dated Jul. 17, 2000, 9pp.
Notice of Allowability for U.S. Appl. No. 09/521,875 dated Sep. 17, 2002, 1pp.
Office Action for U.S. Appl. No. 09/521,875 dated Jun. 11, 2002, 2pp.
Office Action for U.S. Appl. No. 09/521,875dated Dec. 21, 2001, 9pp.
Office Action for U.S. Appl. No. 09/521,875 dated Oct. 11, 2001, 2pp.
Office Action for U.S. Appl. No. 09/521,875 dated Jun. 20, 2001, 4pp.
International Search Report for Application No. WO 2004/005090 A3 dated Feb. 24, 2005, 2pp.
Written Opinion for Application No. PCT/USO4/05090 dated Feb. 24, 2005, 3pp.
Brewer, Kathleen Pearl, Cummings, Leslie E., "Gaming language: getting a handle on slots", Cornell Hotel & Restaurant Administration Quarterly, Apr. 1995, Section: vol. 36, No. 2, p. 74, ISSN: 0010-8804, 7pp.
Rose, Bob, "New Ways for the House to Win", St. Louis Post-Dispatch, Oct. 3, 1996, Section: Get Out, p. 50, 2pp.
Brochure: "Power Play Slots", (http //www softsite com/ulti/), Jan. 1997, 13pp.
Author Unknown; "Innovative Gaming Announces Nevada Approval of IGT Joint Venture Game—Bonus Streak", PR Newswire; May 14, 1997, Section: Financial News, 2pp.
Poole, David, "Letter From Charlotte: Vegas Perfect for Racing", Las Vegas Review-Journal, Jun. 22, 1997, Section C, p. 2C, 2pp.
"Shuffle Master Begins Immediate Rollout of Five Deck Frenzy and Introduces New Version of Let it Ride", PR Newswire, Jun. 30, 1997, Section: Financial News, 3pp.
Review: "Five Deck Frenzy", by Shuffle Master and IGT, (hap //pitboss com/R-5deck shtm), download date: Feb. 1, 1998, 1pp.
Cook, Melissa, "The Best New Slots", Casino Player Magazine, Apr. 1998, p. 45, 5pp.
Grochowski, John; "Royal Is Worth Taking a Risk" Chicago Sun Times, Apr. 5, 1998, Section: SHO, Casinos, p. 1.8; NC, 4pp.
Green, Marian; "The New Slot Market", International Gaming & Wagering Business, May 1998, vol. 19, No. 5, 7pp.
Website: "World of Slots—The Game King", Casino Journal, (http://www.casinocenter.com/journal/oct97/html/igt.html), download date Jun. 4, 1998, 5pp.
Website: "A New Generation", Casino Journal (http://www.casinocenter.com/journal/oct97/html/bally html), download date Jun. 4, 1998, 5pp.
Author Unknown; "The Interactive Experience", Casino Journal (http://www.casinocenter. com/journal/oct97/html/ac_ coin.html), download date Jun. 4, 1998, 3pp.
Brokopp, John, "New Slots Send Up Caution Flag", (http //brokopp casinocitytimes com/articles/545 html), dated: Aug. 2, 1999, 2pp.
Brochure: "Vision Series—5-Line Double Diamond Mine", IGT, Copyright 2000, 1pp.
Website: "Double Diamond Mine Slots", (http //www igt com/GamingGroup/Games/game asp?pid=5.12.108.119&theme_ id=2390), download date: Feb. 9, 2004, 1pp.
Legato, Frank, "When a Bonus . . . Isn't", Strictly Slots, (http //www strictlyslots com/archive/0006ss/html/behind html), download date: Feb. 9, 2004, 3pp.
Website: "Wild Wizard Slots", Gameportcom, (http //www gameport com/pcgames/cards/000075 html), download date: Feb. 9, 2004, 2pp.
Website: "Williams X—Factor—3 Coin Dotmation" "AzSlot Machine Company—Used Slot Machines and Slot Machine Parts for Sale", (http //www slotdepot corn/723 htm), download date: Feb. 9, 2004, 2pp.
Fey, A Pictorial History of Slot Machines, The First 100 Years, Liberty Belle Books, 1983, p. 89, 2pp.
International Preliminary Report on Patentability for Application No. PCT/USO4/05090 dated Apr. 6, 2005, 4pp.
Letter from Marvin A. Motsenbocker of Mots Law dated May 15, 2012 regarding Third Party Submission in Published Application Under 37 C.F.R. 1.99 filed for U.S. Appl. No. 13/299,015 (1 page).
Third Party Submission in Published Application Under 37 C.F.R. 1.99 filed for U.S. Appl. No. 13/299,015, dated May 15, 2012 (3 pages).

* cited by examiner

318

| RANDOM NUMBER 400 | OUTCOME 402 |
|---|---|
| 0 TO 10 | BAR, BAR, BAR |
| 11 TO 1,000 | CHERRY, CHERRY, CHERRY |
| 1,001 TO 1,000,000 | ANY, ANY, ANY |

FIG. 4

320

| OUTCOME 500 | PAYOUT 502 |
|---|---|
| BAR, BAR, BAR | 100 |
| CHERRY, CHERRY, CHERRY | 10 |
| ANY, ANY, ANY | 0 |

FIG. 5

322

| PARAMETER TYPE 600 | PARAMETER VALUES 602 | PARAMETER VALUES PROBABILITIES 604 | CURRENT VALUE 608 |
|---|---|---|---|
| CARROTS | 8 | 10% | 12 |
| | 10 | 40% | |
| | 12 | 40% | |
| | 15 | 10% | |
| RABBITS | 2 | 25% | 6 |
| | 4 | 50% | |
| | 6 | 25% | |

FIG. 6

METHOD AND APPARATUS FOR SETTING GAME PARAMETERS

PRIORITY CLAIM

This application is a continuation application of, claims priority to and the benefit U.S. patent application Ser. No. 11/556,399, filed on Nov. 3, 2006, which is a divisional application of, claims priority to and the benefit of U.S. patent application Ser. No. 10/784,845, filed on Feb. 23, 2004, now U.S. Pat. No. 7,427,233, which claims priority to and the benefit of U.S. Provisional Patent Application Ser. No. 60/449,270, filed on Feb. 21, 2003, the entire contents of each are incorporated by reference herein.

RELATED APPLICATIONS

The following patent applications include subject matter that is related to the present application: U.S. patent application Ser. No. 10/778,576, filed Feb. 13, 2004, entitled "METHOD AND APPARATUS FOR ENHANCED PLAY OF A GAMING DEVICE"; which is a continuation-in-part of U.S. patent application Ser. No. 10/772,837, filed Feb. 5, 2004, entitled "ELECTRONIC AMUSEMENT DEVICE AND METHOD FOR ENHANCED SLOT MACHINE PLAY"; and also a continuation-in-part of U.S. patent application Ser. No. 09/716,918, filed Nov. 20, 2000, entitled "ELECTRONIC AMUSEMENT DEVICE AND METHOD FOR ENHANCED SLOT MACHINE PLAY"; which is a continuation of U.S. patent application Ser. No. 09/164,473, filed Oct. 1, 1998, entitled "ELECTRONIC AMUSEMENT DEVICE AND METHOD FOR ENHANCED SLOT MACHINE PLAY", which issued as U.S. Pat. No. 6,203,430 B1 on Mar. 20, 2001.

The present application is also related to subject matter contained in U.S. patent application Ser. No. 10/752,068, filed Jan. 6, 2004, entitled "ELECTRONIC AMUSEMENT DEVICE OFFERING SECONDARY GAME OF CHANCE AND METHOD FOR OPERATING SAME", which is a continuation of U.S. patent application Ser. No. 10/029,143, filed Dec. 27, 2001, entitled "ELECTRONIC AMUSEMENT DEVICE OFFERING SECONDARY GAME OF CHANCE AND METHOD FOR OPERATING SAME", which issued as U.S. Pat. No. 6,692,353 B2 on Feb. 17, 2004; and which is a continuation of U.S. patent application Ser. No. 09/108,646, filed Jul. 1, 1998, entitled "ELECTRONIC AMUSEMENT DEVICE OFFERING SECONDARY GAME OF CHANCE AND METHOD FOR OPERATING SAME", which issued as U.S. Pat. No. 6,364,765 B1 on Apr. 2, 2002.

The present application is also related to subject matter contained in U.S. patent application Ser. No. 10/361,201, filed Feb. 7, 2003, entitled "A GAMING DEVICE AND METHOD OF OPERATION THEREOF"; which is a continuation-in-part of U.S. patent application Ser. No. 09/521,875, filed Mar. 8, 2000, entitled "A GAMING DEVICE AND METHOD OF OPERATION THEREOF", which issued as U.S. Pat. No. 6,520,856 B1 on Feb. 18, 2003; which is a continuation of U.S. patent application Ser. No. 09/052,291, filed Mar. 31, 1998; entitled "A GAMING DEVICE AND METHOD OF OPERATION THEREOF", which issued as U.S. Pat. No. 6,068,552 on May 30, 2000.

The entire content of each of the above-referenced patents/applications is incorporated herein by reference for all purposes

SUMMARY

The present invention relates to gaming and gaming devices. More specifically, the present invention relates to methods for determining and setting parameters used in the play of games.

Gaming devices (e.g., reeled slot machines, video poker machines, etc.) generate more than $15 billion per year in revenue for casinos in the United States alone. This revenue accounts for more than half of the total gaming revenue for a typical United States casino. The situation is similar in other countries and regions in which gaming devices are popular, such as Europe and Australia. Accordingly, casino operators are interested in increasing the enjoyment of playing a slot machine in order to maintain or increase this level of revenue.

Since casino profits are directly proportional to the amount wagered by patrons, casinos are highly motivated to expand and retain share within their given market. Play duration, average wager amount, and rate of play are significant factors contributing to the profitability of the slot floor of a casino.

One way in which casinos have sought to boost profitability associated with these factors is to make the machines as entertaining as possible. Many techniques are currently used to entertain players at a slot machine, such as the use of attractive colors and graphics, sound effects associated with winning payouts, and jackpots or bonus rounds that offer players the chance to win a large amount of money for only a small wager. While such efforts have made modern slot machines more entertaining than the previous generation of machines, competing entertainment options open to consumers have expanded. Casinos now compete not only with the casino across the street, but with alternative player entertainment options such as home theater systems, handheld video game devices, greatly expanded television and movie offerings, and the like. Accordingly, a need exists for enhancing the entertainment value of gaming devices.

Additional features and advantages are described herein, and will be apparent from the following Detailed Description and the figures.

BRIEF DESCRIPTION OF THE FIGURES

FIG. 4 is a table illustrating an example data structure of a probability database for use in some embodiments of the present invention.

FIG. 5 is a table illustrating an example data structure of a payout database for use in some embodiments of the present invention.

FIG. 6 is a table illustrating an example data structure of a parameter value database for use in some embodiments of the present invention.

DETAILED DESCRIPTION

Figure 1:
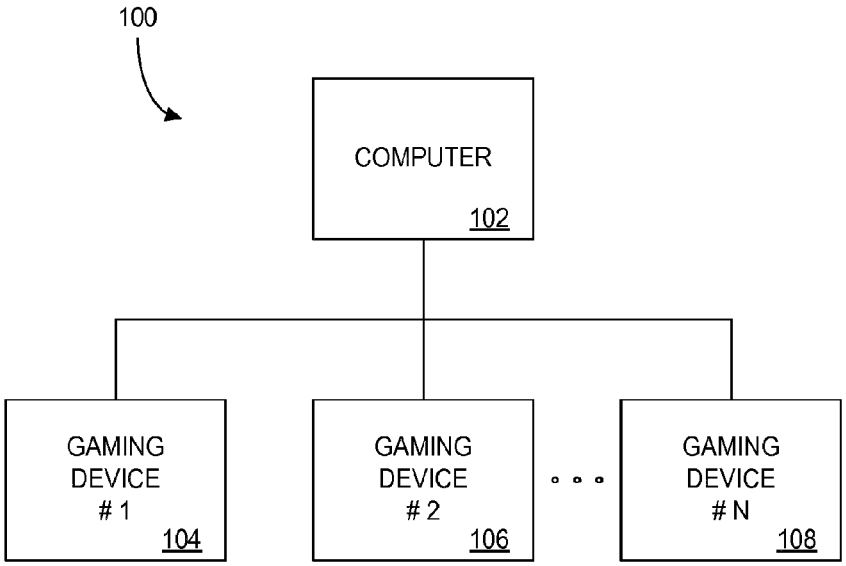
FIG. 1 is a block diagram illustrating an example system according to some embodiments of the present invention.

The invention overcomes the above and other drawbacks of the prior art by allowing gaming devices to set or modify game parameters through the use of random events such as spinning slot machine reels. In some embodiments, game parameters may be established with various initial values, and then, by spinning the gaming devices' reels, for example, random reel values lining up on the payline may be used as new game parameter values. Parameter values may be used to control almost any aspect of the gaming device play experience, ranging from the types of symbols seen on the reels to the rate at which "complementary" points are awarded.

With these and other advantages and features of the invention that will become hereinafter apparent, the nature of the invention may be more clearly understood by reference to the following detailed description of the invention, the appended claims and to the several drawings included herein.

In the following description, reference is made to the accompanying drawings that form a part hereof, and in which is shown, by way of illustration, specific embodiments in which the invention may be practiced. These embodiments are described in sufficient detail to enable those skilled in the art to practice the invention, and it is to be understood that other embodiments may be utilized and that structural, logical, software, hardware, and electrical changes may be made without departing from the scope of the present invention. The following description is, therefore, not to be taken in a limited sense, and the scope of the present invention is defined by the appended claims.

A. TERMS

Throughout the description that follows and unless otherwise specified, the following terms may include and/or encompass the example meanings provided in this section. These terms and illustrative example meanings are provided to clarify the language selected to describe embodiments of the invention both in the specification and in the appended claims.

The term "basic game" may refer to play resulting from the spinning of standard physical or graphical slot reels, the dealing of physical or electronic cards, or other game outcomes. The outcome of a basic game might be cherry-cherry-bar, 4 hits on a 7-spot keno ticket, or the hand Ks (king of spades), Qd (queen of diamonds), 4h (four of hearts), 2s (two of spades), 6s (six of spades) in video poker.

The term "bonus game" may refer to a secondary game separate from the basic game in which the player typically does not have to wager any additional coins and has the possibility of winning a relatively large number of coins.

The term "game play parameter" may refer to variables whose values govern aspects of play at the gaming device exclusive of variables directly related to payout amounts, pay table selection, and payout probabilities. The value of a game play parameter may be determined by a random selection process. Examples include the number of bar symbols on the second reel, the number of handle pulls for which a bonus mode will remain active, the probability of a game character appearing on a given handle pull, a required wager amount per handle pull, and the initial number of cards a player is dealt in a poker game.

The term "game parameter" may refer to variables whose values govern play at the gaming device and are determined by a random selection process. Game parameters include game play parameters. Examples of game parameters include the payout for bar-bar-bar, the number of cherry symbols on the first reel, and the probability of a game character finding hidden treasure.

The term "game parameter value" may refer to a value associated with a game parameter, such as 200 coins, 12 cherry symbols, or a 30% chance of finding treasure.

The term "game parameter value symbol" may refer to a reel symbol that represents a game parameter value, such as a reel symbol displaying "200 coins" or "12 cherry symbols." The symbol could also be found on other representations of random events such as spinners, which could be located on a secondary screen.

The terms "controller" and "computer" shall be synonymous and may refer to an electronic device (e.g., a personal computer) that communicates with one or more gaming devices. In a manner well known in the art, a controller may function as a computer server and may control the actions of gaming devices. A controller may also contain databases to record statistics such as coin-in, coin-out, jackpot information, theoretical wins, etc.

The term "game" may refer to a gambling event with a beginning and end that may encompass a number of spins, handle pulls, or span of time. The end of the game may be determined voluntarily (in which the player elects to stop play) or involuntarily (in which the gaming device terminates play).

The term "game character" may refer to a character, which may be a cartoon and/or digitally generated, which is involved in the game playing experience. The character may entertain the player, explain payouts, try to steal objects from the player, try to defend objects held by the player, and the like. The character could be a life-like animation of a television character, or even just the audio associated with a well-known character.

The term "gaming device" may refer to any electrical, mechanical, or electromechanical device that, in a manner well known in the art, accepts wagers, steps through a process to determine an outcome, and pays winnings based on the outcome. The outcome may be randomly generated, as with a slot machine; may be generated through a combination of randomness and player skill, as with video poker; or may be generated entirely through player skill. Gaming devices may include slot machines (both video and mechanical reels), video poker machines, video blackjack machines, video roulette machines, video keno machines, video bingo machines, pachinko machines, video lottery terminals, handheld gaming devices, and the like.

The term "handle pull" may refer to a single play at a gaming device whether or not a handle is involved in the play and whether or not a handle is even included in the gaming device. The meaning is intended to be flexible in that a single handle pull might constitute a single complete game, or a single wager. For example, a handle pull might represent a single spin of the reels or a series of spins which culminate in a final aggregate outcome. In a video poker embodiment, handle pulls may result in a first and second hands, both in the same game.

The term "outcome" may refer to a result of gaming event, such as cherry-cherry-cherry in a slot machine game, a push in blackjack, a flush in video poker, the completion of a puzzle, the attainment of a goal, etc. Different types of gaming devices may have widely varying types of outcomes. Several are described in detail herein and still others will be apparent to those of skill in the art based on the present disclosure.

The term "payout" may refer to a prize, reward, winnings, or bonus associated with a certain outcome.

The term "peripheral device" may refer to a device operatively connected to a gaming device that is configured to assist in the operation of game-related functions. In some embodiments peripheral devices may be located near players at a table game.

The term "player tracking card" may refer to a casino issued plastic or paper card (resembling a frequent shopper card) given to players as a way of identifying the player at a slot machine or table game. As is well known in the art, such cards typically have encoded thereon (in machine-readable and/or human readable form) a player identifier (e.g., a six digit number) which uniquely identifies the player (e.g., because the number is associated with a record in a database that includes corresponding player information). At a slot machine, the player inserts the card into a reader device and the player identifier is read from the card, most often magnetically. From the player identifier which the reader device reads, the corresponding player information may in turn be read from the database, typically via a network connection between the reader device and a deice hosting the database.

The term "prepaid session" may refer to a quantity of time or handle pulls that are paid for in advance. Once a session is prepaid, the player does not need to supply any additional funds until the session has been completed. A prepaid session may allow the player to complete many games during the session.

The term "primary game screen" may refer to a screen used to display game information such as a video representation of one or more spinning reels.

The term "secondary game screen" may refer to a screen used to display secondary game information such as the animation and graphics associated with a bonus round.

B. SYSTEM

An example embodiment of the system 100 of the present invention is depicted in FIG. 1. The present invention can be configured to work as a system 100 in a network environment including a computer 102 (e.g., a slot server of a casino) that is in communication, via a communications network, with one or more gaming devices 104, 106, 108 (e.g., slot machines, video poker machines). The computer 102 may communicate with the gaming devices directly or indirectly, via a wired or wireless medium such as the Internet, LAN, WAN or Ethernet, Token Ring, or via any appropriate communications means or combination of communications means. Each of the gaming devices 104, 106, 108 may comprise computers, such as those based on the Intel® Pentium® processor, that are adapted to communicate with the computer 102. Any number and type of devices 104, 106, 108 may be in communication with the computer 102.

Communication between the devices 104, 106, 108 and the computer 102, and among the devices 104, 106, 108, may be direct or indirect, such as over the Internet through a Web site maintained by computer on a remote server or over an on-line data network including commercial on-line service providers, bulletin board systems and the like. In yet other embodiments, the devices 104, 106, 108 may communicate with one another and/or the computer 102 over RF, cable TV, satellite links and the like.

Some, but not all, possible communication networks that may comprise the network or be otherwise part of the system 100 include: a local area network (LAN), a wide area network (WAN), the Internet, a telephone line, a cable line, a radio channel, an optical communications line, and a satellite communications link. Possible communications protocols that may be part of the system include: Ethernet (or IEEE 802.3), SAP, ATP, Bluetooth™, and TCP/IP. Communication may be encrypted to ensure privacy and prevent fraud in any of a variety of ways well known in the art.

Those skilled in the art will understand that devices in communication with each other need not be continually transmitting to each other. On the contrary, such devices need only transmit to each other as necessary, and may actually refrain from exchanging data most of the time. For example, a device in communication with another device via the Internet may not transmit data to the other device for weeks at a time.

In some embodiments, a server computer 102 may not be necessary and/or preferred. For example, the present invention may, in one or more embodiments, be practiced on a stand-alone gaming device 104 and/or a gaming device 104 in communication only with one or more other gaming devices 106, 108 (i.e. with a computer server 102). In such embodiments, any functions described as performed by the computer 102 or data described as stored on the computer 102 may instead be performed by or stored on one or more gaming devices 104, 106, 108.

Figure 2:
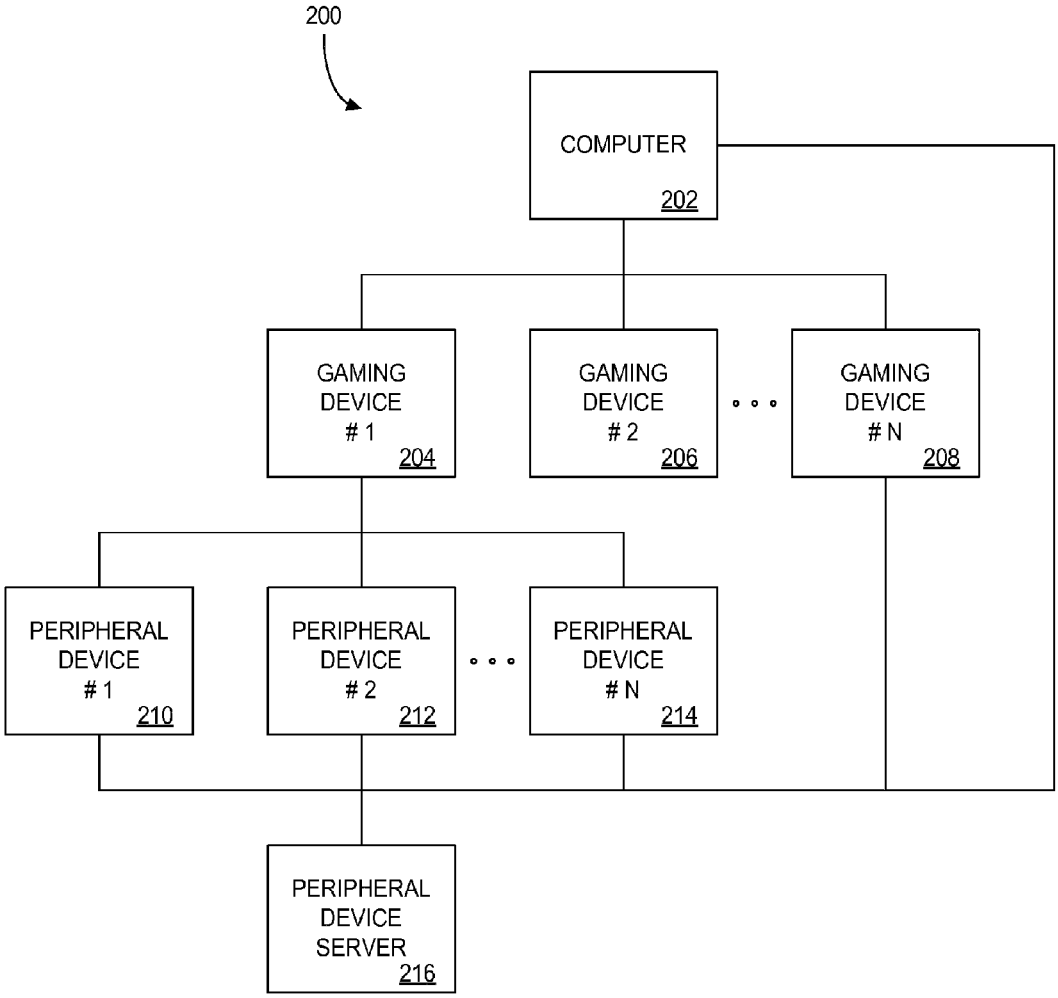
FIG. 2 is a diagram illustrating an example alternative system according to some embodiments of the present invention.

Turning to FIG. 2, an alternative system 200 according to some embodiments of the present invention includes a computer 202 (e.g. a slot server of a casino) that is in communication, via a communications network, with one or more gaming devices 204, 206, 208 (e.g., slot machines, video poker machines). A difference between the aforementioned system 100 and this alternative system 200 is that in this system 200 at least one gaming device 204 is also in communication with one or more peripheral devices 210, 212, 214. A peripheral device 210, 212, 214 may, in turn, be in communication with a peripheral device server 216 and, in some embodiments, with the computer 202. In some embodiments the peripheral device server 216 may be in communication with one or more gaming devices 204, 206, 208 and/or the computer 216.

The computer 202 may communicate with the devices 204, 206, 208 and peripherals 210, 212, 214 directly or indirectly, via a wired or wireless medium such as the Internet, LAN, WAN or Ethernet, Token Ring, or via any appropriate communications means or combination of communications means. For example, the computer 202 may communicate directly with one of the gaming devices 204, 206, 208 (e.g. via a LAN) and indirectly (e.g., via a gaming device) with a peripheral device 210, 212, 214. In another example, the computer 202 may communicate with one of the gaming devices 204 via a LAN and with another of the gaming devices 208 via the Internet (e.g., if the particular gaming device 208 comprises a personal computer in communication with an online casino).

Each of the devices 202, 204, 206, 208, 210, 212, 214, 216 of the system 200 may comprise computers, such as those based on the Intel® Pentium® processor, that are adapted to communicate with the computer. Further, each of the devices 202, 204, 206, 208, 210, 212, 214, 216 may comprise a gaming device such as a mechanical or electronic slot machine, a video poker machine, a video blackjack machine, a video keno machine, a pachinko machine, a video roulette machine, and/or a lottery terminal. Further yet, each of the devices 202, 204, 206, 208, 210, 212, 214, 216 may comprise an external or internal module associated with one or more of the gaming devices 204, 206, 208 that is capable of communicating with one or more of the gaming devices 204, 206, 208 and of directing the one or more gaming devices 204, 206, 208 to perform one or more functions. Any number of devices 204, 206, 208, 210, 212, 214, 216 may be in communication with the computer 202. Any number and type of peripheral devices 210, 212, 214 may be in communication with a gaming device 204, peripheral device server 216 and the computer 202.

Communication between the devices 204, 206, 208, 210, 212, 214 and the computer 202, between each of the devices 204, 206, 208, 210, 212, 214, between the peripheral device server 216 and the devices 204, 206, 208, 210, 212, 214, and between the peripheral device server 216 and the computer 202, may be direct or indirect, such as over the Internet through a Web site maintained by the computer 202 on a remote server or over an on-line data network including commercial on-line service providers, bulletin board systems and the like. In yet other embodiments, any and all of the devices 202, 204, 206, 208, 210, 212, 214, 216 of the system 200 (i.e., the devices 204, 206, 208, 210, 212, 214, the computer 202, and the peripheral device server 216) may communicate with one another over RF, cable TV, satellite links and the like.

Some, but not all, possible communication networks that may comprise the network or otherwise be part of the system include: a local area network (LAN), a wide area network (WAN), the Internet, a telephone line, a cable line, a radio channel, an optical communications line, a satellite communications link. Possible communications protocols that may be part of the system include: Ethernet (or IEEE 802.3), SAP, ATP, Bluetooth™, and TCP/IP. Communication may be encrypted to ensure privacy and prevent fraud in any of a variety of ways well known in the art.

Similarly, a peripheral device server 216 may not be desired and/or needed in some embodiments of the present invention. In embodiments that do not involve a peripheral device server 216, any or all of the functions described herein as being performed by a peripheral device server 216 may instead be performed by another server computer, the computer 202, one or more gaming devices 204, 206, 208, one or more peripheral devices 210, 212, 214, or a combination thereof. Similarly, in embodiments that do not involve a peripheral device server 216 any data described herein as being stored in a memory of a peripheral device server 216 may instead be stored in a memory of another server computer, the computer 202, one or more gaming devices 204, 206, 208, one or more peripheral devices 210, 212, 214, or a combination thereof.

Any or all of the gaming devices 204, 206, 208 may, respectively, include or be in communication with a peripheral device 210. A peripheral device 210 may be a device that receives information from (and/or transmits information to) one or more gaming devices 204, 206, 208. For example, a peripheral device 210 may be operable to receive information about games being played on a gaming device 204, such as the initiation of a game and/or a random number that has been generated for a game.

In one or more embodiments, one or more such peripheral devices 210, 212, 214 may be in communication with a peripheral device server 216. This allows the peripheral device server 216 to receive information regarding a plurality of games being played on a plurality of gaming devices 204, 206, 208. The peripheral device server 216, in turn, may be in communication with the computer 202. It should be understood that any functions described herein as performed by a peripheral device 210 may also or instead be performed by the peripheral device server 216. Similarly, any data described herein as being stored on or accessed by a peripheral device 210 may also or instead be stored on or accessed by the peripheral device server 216.

A peripheral device 210 may be operable to access a database (e.g. of a peripheral device server 216) to provide benefits (e.g., cashless gaming receipts) based on, for example, an actual outcome of a game.

The peripheral device server 216 may also monitor player gambling history over time by associating gambling behavior with player identifiers, such as player tracking card numbers. For example, information about the player obtained or accessed by a peripheral device server 216 may be analyzed, e.g. to identify those players that a particular gaming machine owner, operator, or manufacturer finds most desirable. Based upon desired objectives, the peripheral device server 216 may direct the appropriate peripheral device 210 to issue customized messages, offers, and games to specific players.

Information received by a peripheral device 210 from a gaming device 204 may include gambling data such as number of games initiated per unit of time, outcomes displayed for games initiated, payouts corresponding to outcomes displayed, a credit meter balance of the gaming device 204, and/or data associated with the player currently playing the gaming device 204.

The functions described herein as being performed by a peripheral device server 216 and/or a peripheral device 210 may, in one or more embodiments, be performed by the computer 202 (in lieu of or in conjunction with being performed by a peripheral device server 216 and/or a peripheral device 210).

In some embodiments, a peripheral device 210 may be useful for implementing the embodiments of the present invention into the operation of a conventional gaming device.

For example, in order to avoid or minimize the necessity of modifying or replacing a program already stored in a memory of a conventional gaming device, an external or internal module that comprises a peripheral device 210 may be inserted in or associated with a conventional gaming device to transform it into a gaming device 204 of the present invention.

Thus, for example, a peripheral device 210 may be utilized to monitor play of the gaming device 204 and output messages and an outcome of a game. In such embodiments the gaming device 204 with which the peripheral device 210 is in communication may continue to operate conventionally. In such embodiments the gaming device 204 may continue to output an outcome for each game played. The peripheral device 210, however, may output a second outcome or payout when appropriate. The peripheral device 210 may also output messages to the player. The peripheral device 210 may also provide benefits to a player (e.g., coins, tokens, electronic credits, paper receipts exchangeable for cash, services, and/or merchandise).

Accordingly, a peripheral device 210 may include (i) a communications port (e.g. for communicating with one or more gaming devices, peripheral device server, another peripheral device, and/or computer; (ii) a display (e.g., for displaying messages and/or outcomes and payouts), (iii) another output means (e.g., a speaker, light, or motion device to communicate with a player), and/or (iv) a benefit providing means (e.g., a printer and paper dispensing means, a credit meter, and/or a hopper and hopper controller).

In some embodiments, a peripheral device 210 may not output outcomes and/or messages to a player but may instead direct the processor 300 of a gaming device 104/204 to perform such functions. For example, a program stored in a memory of peripheral device 210 may cause a processor 300 of a gaming device 104/204 to perform certain functions. For example, a program stored in a memory of peripheral device 210 may cause a processor 300 of a gaming device 104/204 to output an outcome, determine an outcome, output a message, access a database, provide a benefit, refrain from providing a benefit (e.g., by not sending a signal to a hopper controller of the gaming device when it otherwise normally would), and/or communicate with another device. Examples of peripheral devices 210, 212, 214 include (1) electronic apparatuses "retrofitted" to conventional gaming devices so that inventive processes disclosed herein may be realized through game play at the gaming device 104/204, (2) Personal Digital Assistants such as those manufactured by Palm, Inc., (3) lap top computers, (4) cellular telephones, (5) pagers, or (6) any combination thereof.

C. DEVICES

Figure 3:
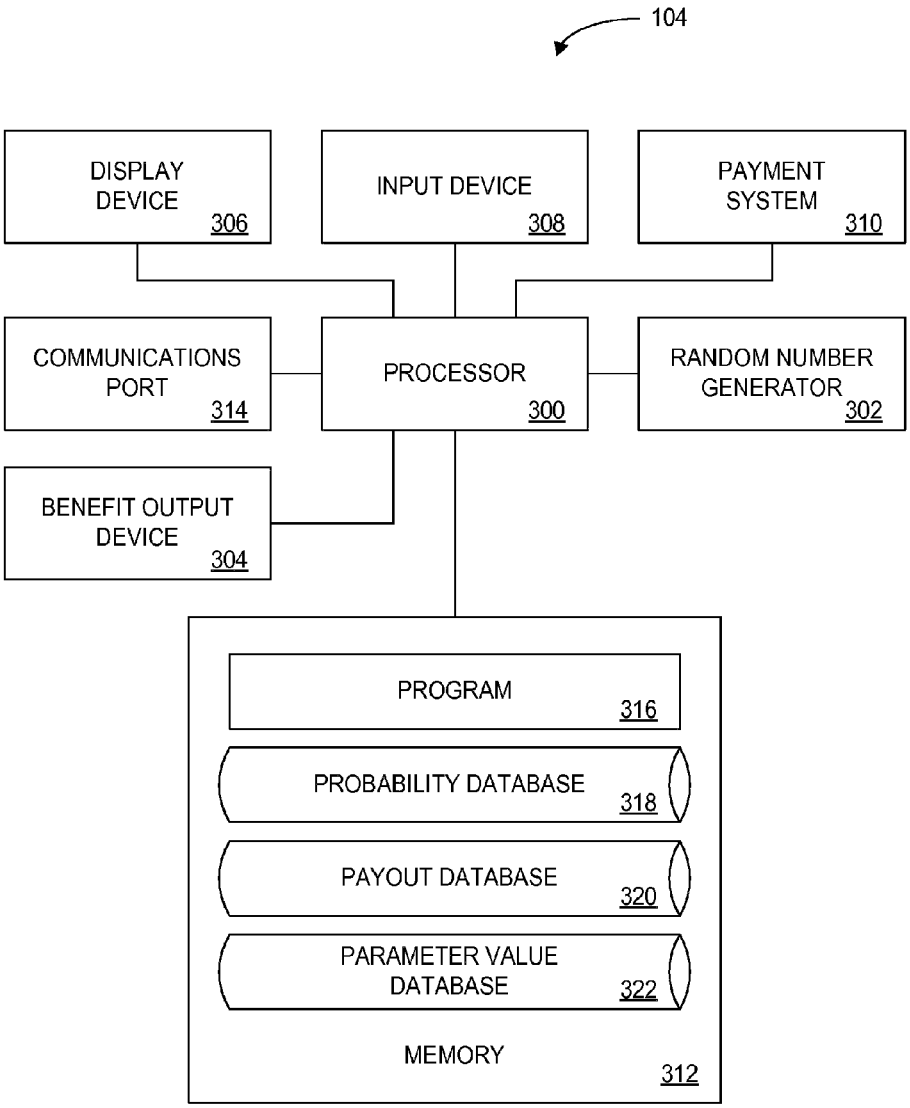
FIG. 3 is a diagram illustrating an example gaming device according to some embodiments of the present invention.

Turning to FIG. 3, a gaming device 104 may be implemented as a system controller, a dedicated hardware circuit, an appropriately programmed general-purpose computer, or any other equivalent electronic, mechanical or electro-mechanical device. As indicated above, the gaming device 104/204 may comprise, for example, a slot machine, a video poker machine, a video blackjack machine, a video keno machine, a video lottery machine, a pachinko machine or a table-top game. In various embodiments, a gaming device 104/204 may comprise, for example, a personal computer (e.g., which communicates with an online casino Web site), a telephone (e.g., to communicate with an automated sports book that provides gaming services), or a portable handheld gaming device (e.g. a personal digital assistant or Nintendo GameBoy®). The gaming device 104/204 may comprise any or all of the gaming devices of the aforementioned systems. In some embodiments, a user device such as a PDA or cell phone may be used in place of, or in addition to, some or all of the gaming device components. Further, a gaming device 104/204 may comprise a personal computer or other device operable to communicate with an online casino and facilitate game play at the online casino. In one or more embodiments, the gaming device 104/204 may comprise a computing device operable to execute software that simulates play of a reeled slot machine game, video poker game, video blackjack game, video keno game, video roulette game, or lottery game.

In some embodiments, a gaming device 104/204 may comprise a processor 300, such as one or more Intel® Pentium® processors. The processor 300 is operable to communicate with a random number generator 302, which may be a component of the gaming device 104. The random number generator 302, in accordance with some embodiments of the present invention, may generate data representing random or pseudo-random values (referred to as "random numbers" herein). The random number generator 302 may generate a random number every predetermined unit of time (e.g., every thousandth of a second) or in response to an initiation of a game on the gaming device 104. In some embodiments, the generated random numbers may be used as they are generated (e.g., the random number generated at substantially the time of game initiation is used for that game) and/or stored for future use. A random number generated by the random number generator 302 may be used by the processor 300 to determine, for example, at least one of an outcome and payout. A random number generator 302, as used herein, may be embodied as a processor separate from but working in cooperation with the processor 300. Alternatively, the random number generator 302 may be embodied as an algorithm, program component, or software stored in the memory of the gaming device 104 and used to generate a random number.

Note that, although the generation or obtainment of a random number is described herein as involving a random number generator 302 of a gaming device 104, other methods of determining a random number may be employed. For example, a gaming device owner or operator may obtain sets of random numbers that have been generated by another entity. HotBits™, for example, is a service that provides random numbers that have been generated by timing successive pairs of radioactive decays detected by a Geiger-Muller tube interfaced to a computer. A blower mechanism that uses physical balls with numbers thereon may be used to determine a random number by randomly selecting one of the balls and determining the number thereof.

The processor 300 may also be operable to communicate with a benefit output device 304, which may be a component of gaming device 104. The benefit output device 304 may comprise one or more devices for outputting a benefit to a player of the gaming device. For example, in some embodiments the gaming device 104 may provide coins and/or tokens as a benefit. In such embodiments, the benefit output device 304 may comprise a hopper and hopper controller, for dispensing coins and/or tokens into a coin tray of the gaming device. In another example, the gaming device 104 may provide a receipt or other document on which there is printed an indication of a benefit (e.g., a cashless gaming receipt that has printed thereon a monetary value, which is redeemable for cash in the amount of the monetary value). In such an embodiment, the benefit output device 304 may comprise a printing and document dispensing mechanism. In yet another example, the gaming device 104 may provide electronic credits as a benefit (which, e.g. may be subsequently converted to coins and/or tokens and dispensed from a hopper into a coin tray). In such embodiments, the benefit output device 304 may comprise a credit meter balance and/or a processor that manages the number of electronic credits that is indicated on a display of a credit meter balance. In yet another example, the gaming device 104 may credit a monetary amount to a financial account associated with a player as a benefit provided to a player. The financial account may be, for example, a credit card account, a debit account, a charge account, a checking account, or a casino account. In such embodiments, the benefit output device 304 may comprise a device for communicating with a server on which the financial account is maintained.

Note that, in one or more embodiments, the gaming device 104 may include more than one benefit output device 304. For example, the gaming device 104 may include both a hopper and hopper controller combination and a credit meter balance. Such a gaming device 104 may be operable to provide more than one type of benefit to a player of the gaming device 104. A single benefit output device 304 may be operable to output more than one type of benefit. For example, a benefit output device 304 may be operable to increase the balance of credits in a credit meter and communicate with a remote device in order to increase the balance of a financial account associated with a player.

The processor 300 is also operable to communicate with a display device 306, which may be a component of gaming device 104. The display device 306 may comprise, for example, one or more display screens or areas for outputting information related to game play on the gaming device, such as a cathode ray tube (CRT) monitor, liquid crystal display (LCD) screen, or light emitting diode (LED) screen. In one or more embodiments, a gaming device 104 may comprise more than one display device 306. For example, a gaming device may comprise an LCD display for displaying electronic reels and a display area that displays rotating mechanical reels.

The processor 300 may also be in communication with one or more other devices (not pictured) besides the display device 306, for outputting information (e.g., to a player or another device). Such other one or more output devices may also be components of a gaming device 104. Such other one or more output devices may comprise, for example, an audio speaker (e.g., for outputting an outcome or information related thereto, in addition to or in lieu of such information being output via a display device), an infra-red transmitter, a radio transmitter, an electric motor, a printer (e.g., such as for printing cashless gaming vouchers), a coupon or product dispenser, an infra-red port (e.g., for communicating with a second gaming device or a portable device of a player), a Braille computer monitor, and a coin or bill dispenser. For gaming devices 104, common output devices include a cathode ray tube (CRT) monitor on a video poker machine, a bell on a gaming device (e.g., rings when a player wins), an LED display of a player's credit balance on a gaming device, an LCD display of a personal digital assistant (PDA) for displaying keno numbers.

As indicated above, the display device 306 may comprise, for example, one or more display areas. For example, one of the display areas may display outcomes of games played on the gaming device 104 (e.g., electronic reels of a gaming device). Another of the display areas may display rules for playing a game of the gaming device 104. Yet another of the display areas may display the benefits obtainable by playing a game of the gaming device 104 (e.g., in the form of a payout table). In one or more embodiments, the gaming device 104 may include more than one display device 306, one or more other output devices, or a combination thereof (e.g., two display devices 306 and two audio speakers).

The processor may also be in communication with an input device 308, which is a device that is capable of receiving an input (e.g., from a player or another device) and which may be a component of gaming device 104. An input device 308 may communicate with or be part of another device (e.g. a server 102, a gaming device 104, etc.). Some examples of input devices 308 include: a bar-code scanner, a magnetic stripe reader, a computer keyboard or keypad, a button, a handle, a keypad, a touch-screen, a microphone, an infrared sensor, a voice recognition module, a coin or bill acceptor, a sonic ranger, a computer port, a video camera, a motion detector, a digital camera, a network card, a universal serial bus (USB) port, a GPS receiver, a radio frequency identification (RFID) receiver, an RF receiver, a thermometer, a pressure sensor, an infrared port (e.g., for receiving communications from a second gaming device or from a another device such as a smart card or PDA of a player), and a weight scale. For gaming devices 104, common input devices 308 may include a button or touch screen on a video poker machine, a lever or handle connected to the gaming device, a magnetic stripe reader to read a player tracking card inserted into a gaming device, a touch screen for input of player selections during game play, and a coin and bill acceptor.

The processor 300 may also be in communication with a payment system 310, which may be a component of the gaming device. The payment system 310 is a device capable of accepting payment from a player (e.g., a bet or initiation of a balance) and/or providing payment to a player (e.g., a payout). Payment is not limited to money, but may also include other types of consideration, including products, services, and alternate currencies. Exemplary methods of accepting payment by the payment system 310 include (i) receiving hard currency (i.e., coins or bills), and accordingly the payment system 310 may comprise a coin or bill acceptor; (ii) receiving an alternate currency (e.g., a paper cashless gaming voucher, a coupon, a non-negotiable token), and accordingly the payment system may comprise a bar code reader or other sensing means; (iii) receiving a payment identifier (e.g., a credit card number, a debit card number, a player tracking card number) and debiting the account identified by the payment identifier; and (iv) determining that a player has performed a value-added activity (e.g., participating in surveys, monitoring remote images for security purposes, referring friends to the casino).

The processor 300 is in communication with a memory 312 and a communications port 314 (e.g., for communicating with one or more other devices). The memory 312 may comprise an appropriate combination of magnetic, optical and/or semiconductor memory, and may include, for example, Random Access Memory (RAM), Read-Only Memory (ROM), a compact disc and/or a hard disk. The memory 312 may comprise or include any type of computer-readable medium. The processor 300 and the memory 312 may each be, for example: (i) located entirely within a single computer or other device; or (ii) connected to each other by a remote communication medium, such as a serial port cable, telephone line or radio frequency transceiver. In some embodiments, the gaming device 104 may comprise one or more devices that are connected to a remote server computer for maintaining databases.

The memory 312 stores a program 316 for controlling the processor 300. The processor 300 performs instructions of the program 316, and thereby operates in accordance with the present invention, and particularly in accordance with the methods described in detail herein. The program 316 may be stored in a compressed, uncompiled and/or encrypted format.

The program 316 furthermore includes program elements that may be necessary, such as an operating system, a database management system and "device drivers" for allowing the processor 300 to interface with computer peripheral devices 302, 304, 306, 308, 310, 312, 314. Appropriate program elements are known to those skilled in the art, and need not be described in detail herein.

The terms "computer-readable medium" or "computer readable media" as used herein may refer to any media or medium that may participate in providing instructions to the processor 300 of the gaming device 104 (or any other processor of a device described herein) for execution. Such a medium may take many forms, including but not limited to, non-volatile media, volatile media, and transmission media. Non-volatile media include, for example, optical or magnetic disks, such as memory. Volatile media include dynamic random access memory (DRAM), which typically constitutes the main memory. Transmission media include coaxial cables, copper wire and fiber optics, including the wires that comprise a system bus coupled to the processor. Transmission media may carry acoustic or light waves, such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave as described hereinafter, or any other medium from which a computer can read.

Various forms of computer readable media may be involved in carrying one or more sequences of one or more instructions to processor 300 (or any other processor of a device described herein) for execution. For example, the instructions may initially be borne on a magnetic disk of a remote computer. The remote computer can load the instructions into its dynamic memory and send the instructions over a telephone line using a modem. A modem local to a gaming device 104 (or, e.g., a server 102) can receive the data on the telephone line and use an infrared transmitter to convert the data to an infrared signal. An infrared detector can receive the data carried in the infrared signal and place the data on a system bus for the processor. The system bus carries the data to main memory, from which the processor retrieves and executes the instructions. The instructions received by main memory may optionally be stored in memory either before or after execution by the processor. In addition, instructions may be received via a communication port 314 as electrical, electromagnetic or optical signals, which are exemplary forms of carrier waves that carry data streams representing various types of information. Thus, the gaming device 104 may obtain instructions in the form of a carrier wave.

According to some embodiments of the present invention, the instructions of the program 316 may be read into a main memory from another computer-readable medium, such from a ROM. Execution of sequences of the instructions in program causes processor perform the process steps described herein. In alternate embodiments, hard-wired circuitry may be used in place of, or in combination with, software instructions for implementation of the processes of the present invention. Thus, embodiments of the present invention are not limited to any specific combination of hardware and software. As discussed with respect to aforementioned systems 100, 200, execution of sequences of the instructions in a program 316 of a peripheral device 210 in communication with the gaming device 104 may also cause the processor 300 to perform some of the process steps described herein.

The memory 312 may also store a plurality of databases 318, 320, 322, including a probability database 318, a payout database 320, and a parameter value database 322. An example of some or all of the data stored in each database 318, 320, 322 is described herein. The described entries of the databases 318, 320, 322 represent exemplary information only; those skilled in the art will understand that the number and content of the entries can be different from those illustrated herein. Further, despite any description of the databases 318, 320, 322 as tables, an object-based model could be used to store and manipulate the data types of the present invention and likewise, object methods or behaviors can be used to implement the processes of the present invention.

Note that, although these databases 318, 320, 322 may be described as being stored in a gaming device 104, in other embodiments of the present invention some or all of these databases 318, 320, 322 may be partially or wholly stored in another device, such as one or more of the peripheral devices 210, 212, 214, the peripheral device server 216 and/or the server computer 102, 202. Further, some or all of the data described as being stored in the databases 318, 320, 322 may be partially or wholly stored (in addition to or in lieu of being stored in the memory 312 of the gaming device 140) in a memory of one or more other devices, such as one or more of the peripheral devices 210, 212, 214, the peripheral device server 216 and/or the server computer 102, 202.

As discussed herein, in one or more embodiments, the gaming device 104 may take the form of a slot machine configured to operate in conjunction with the present invention. A more specific description of a slot machine suitable for use with the present invention follows.

Generally, a slot machine for use in the present invention may comprise a three reel or five reel slot machine. The slot machine comprises a display area in which an outcome for a game of the slot machine is displayed to the player. The display area may, for example, be a video display that displays graphical representations of reels. The display area may, in another example, be glass behind which are located mechanical reels. Within the display area is a payline. In accordance with one or more embodiments of the present invention, an outcome of a game is a set of symbols displayed along a payline of a reeled slot machine. The slot machine may further comprise a handle. A player may initiate the movement of the reels in the display area by pulling on the handle. Alternatively, a player may initiate the movement of the reels in the display area by actuating a start button. Either or both of the handle and start button are exemplary embodiments of the input device 308, described herein.

Where appropriate, the slot machine may also include an alternate, secondary game screen, for outputting information to a player. The secondary game screen may be utilized, for example, to inform a player of which outcome is an actual outcome or that an outcome that is currently being output is not the actual outcome.

The slot machine may also include a payment system 310, which is comprised of a bill acceptor, a credit card reader, cashless receipt/ticket reader, and a coin acceptor. A player may utilize payment system to provide a wager for playing a game and or for providing payment for provision of an outcome.

The slot machine may further comprise a credit meter balance, which is an exemplary embodiment of a benefit output device 304 as described herein. The credit meter balance reflects the amount of electronic credits currently available to a player. The electronic credits may be used by a player, for example, as wagers for games played on the gaming device. The electronic credits may also be "cashed out" as coins, bills, tokens, a cashless gaming receipt, and/or credits to another financial account associated with the player.

Finally, the slot machine may comprise a coin tray. Payment to the player may be rendered by dispensing coins into the coin tray. Such coins may be dispensed based on, for example, a player's indication that the player would like to cash out his credit meter balance and/or a payout obtained by a player as a result of playing a game on the slot machine. The coin tray is an exemplary embodiment of the benefit output device 304 as described herein. Note that, where appropriate, the slot machine may include different and/or additional components besides those discussed above.

D. DATABASES

As indicated above, it should be noted that although the example embodiments depicted in FIG. 3 include three particular databases 318, 320, 322 stored in memory 312, other database arrangements may be used which would still be in keeping with the spirit and scope of the present invention. In other words, the present invention could be implemented using any number of different database files or data structures, as opposed to the three depicted in FIG. 3. Further, the individual database files could be stored on different devices (e.g. located on different storage devices in different geographic locations, such as on a third-party server). Likewise, the program 316 could also be located remotely from the memory 312 and/or on another server. As indicated above, the program 316 may include instructions for retrieving, manipulating, and storing data in the databases 318, 320, 322, as may be useful in performing the methods of the invention as will be further described below.

1. Probability Database

Turning to FIG. 4, a tabular representation of an embodiment of a probability database 318 according to some embodiments of the present invention is illustrated. Where appropriate, a probability database 318 may be utilized in the performance of the inventive processes described herein. A probability database 318 may be stored in the memory 312 in tabular form, or any other appropriate database form, as is well known in the art. The data stored therein may include a number of exemplary records or entries, each defining a random number. Those skilled in the art will understand that the probability database 318 may include any number of entries. The tabular representation may also define fields for each of the entries or records. The fields may specify: (i) a random number 400 or range of random numbers that may be generated by the random number generator 302; and (ii) an outcome 402, that indicates the one or more indicia comprising the outcome that corresponds to the random number of a particular record. A gaming device 104 may utilize a probability database 318 to determine, for example, what outcome corresponds to a random number generated by a random number generator 302 and to display the determined outcome. The outcomes may comprise the three symbols to be displayed along the payline of a three reel slot machine.

Other arrangements of probability databases 318 are possible. For example, the book "Winning At Slot Machines" by Jim Regan (Carol Publishing Group Edition, 1997) illustrates examples of payout and probability tables and how they may be derived. The entirety of this book is incorporated by reference herein for all purposes.

2. Payout Database

Turning to FIG. 5, a tabular representation of an embodiment of a payout database 320 according to some embodiments of the present invention is illustrated. Where appropriate, a payout database 320 may be utilized in the performance of the inventive processes described herein. A payout database 320 may be stored in the memory 312 in tabular form, or any other appropriate database form, as is well known in the art. The data stored therein includes a number of example records or entries, each defining an outcome that may be obtained on a gaming device 104 that corresponds to a payout. Those skilled in the art will understand that the payout database 320 may include any number of entries. The tabular representation also defines fields for each of the entries or records. The fields specify: (i) an outcome 500, which indicates the one or more indicia comprising a given outcome; and (ii) a payout 502 that corresponds to each respective outcome. The outcomes may be those obtained, for example, on a three reel slot machine.

A gaming device 104 may utilize the payout database 320 to determine whether a payout 502 should be output to a player as a result of an outcome 500 obtained for a game. For example, after determining the outcome 500 to output on the gaming device, the gaming device may access the payout database 320 to determine whether the outcome 500 for output is one of the outcomes stored as corresponding to a payout 502, e.g., "BAR, BAR, BAR" or "CHERRY, CHERRY, CHERRY" in FIG. 5. If it is, the gaming device 104 may provide the corresponding payout 502 to the player.

Other arrangements of payout databases are possible. For example, the above incorporated book "Winning At Slot Machines" by Jim Regan illustrates examples of payout and probability tables and how they may be derived.

3. Parameter Value Database

Turning to FIG. 6, a tabular representation of an embodiment of a parameter value database 322 according to some embodiments of the present invention is illustrated. Where appropriate, a parameter value database 322 may be utilized in the performance of the inventive processes described herein. A parameter value database 322 may be stored in the memory 312 in tabular form as depicted in FIG. 6, or any other appropriate database form, as is well known in the art. The data stored therein includes a number of example records or entries, each defining the current parameter value associated with a given parameter as well as possible parameter values and/or the probabilities associated with the selection of parameter value symbols. Those skilled in the art will understand that the parameter value database 322 may include any number of entries. The tabular representation also defines fields for each of the entries or records. The fields specify: (i) a type of parameter 600; (ii) possible parameter values 602 associated with the parameter, (iii) probabilities 604 associated with the possible parameter values, and (iv) current values 608 associated with that parameter. A gaming device 104 may utilize the parameter value database 322 to manage, track, and store parameter values throughout a gaming session.

E. METHODS

The system discussed above, including the hardware components and the databases, are useful to perform the methods of the invention. However, it should be understood that not all of the above described components and databases are necessary to perform any of the present invention's methods. In fact, in some embodiments, none of the above described system is required to practice the present invention's methods. The system described above is an example of a system that would be useful in practicing the invention's methods.

Figure 7:
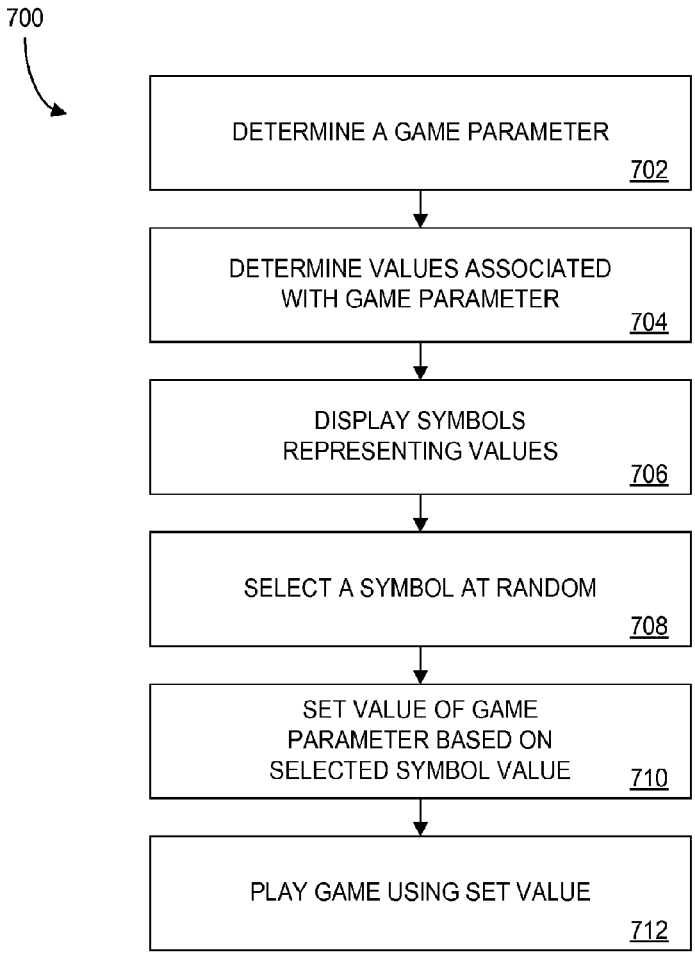
FIG. 7 is a flow chart illustrating an example process according to some embodiments of the present invention.

Referring to FIG. 7, a flow chart 700 is depicted that represents some embodiments of the present invention that may be performed by a computer 102, a gaming device 104, a peripheral device 210, a peripheral device server 216, and/or a casino. It must be understood that the particular arrangement of elements in the flow chart 700 of FIG. 7, as well as the number and order of example steps of various methods discussed herein, is not meant to imply a fixed order, sequence, quantity, and/or timing to the steps; embodiments of the present invention can be practiced in any order, sequence, and/or timing that is practicable. Likewise, the labels used to reference the individual steps of the methods are not meant to imply a fixed order, sequence, quantity, and/or timing to the steps.

In general terms and still referring to FIG. 7, method steps of some embodiments of the present invention may be summarized as follows. In Step 702, one or more game parameters are determined. In Step 704, possible values associated with these game parameters are determined. In Step 706, one or more symbols are displayed, for example, on a reel, each representing a possible value of the one or more game parameters. In Step 708, one or more of the displayed symbols are randomly selected. In Step 710, the value of one or more game parameters are set based on the randomly selected displayed symbols and in Step 712, the game is played using the set value. As indicated above, in some embodiments these steps may be performed in a different order, and that more/fewer/alternative steps may be used as well.

Figure 8:
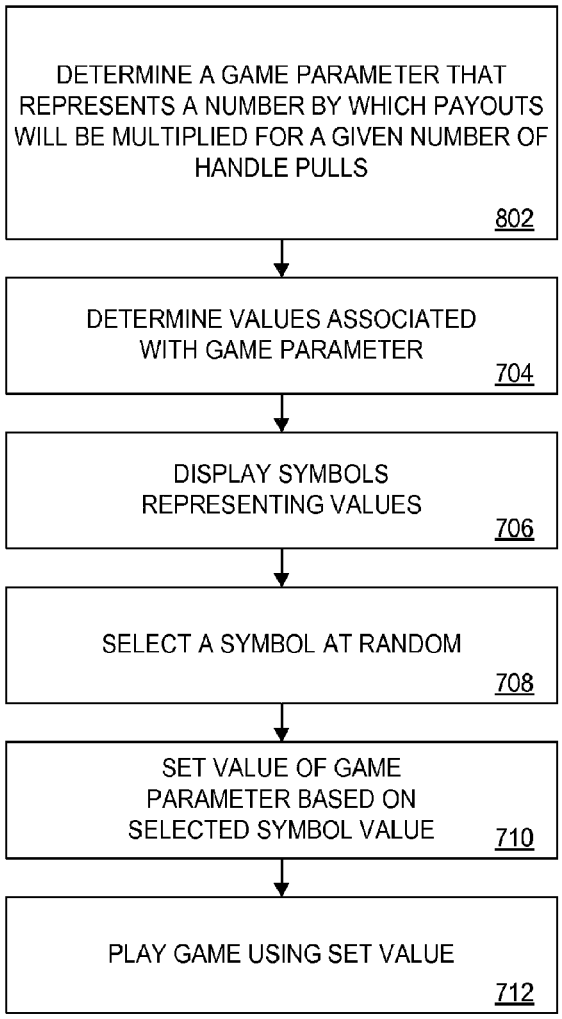
FIG. 8 is a flow chart illustrating an example process according to some embodiments of the present invention.
Figure 9:
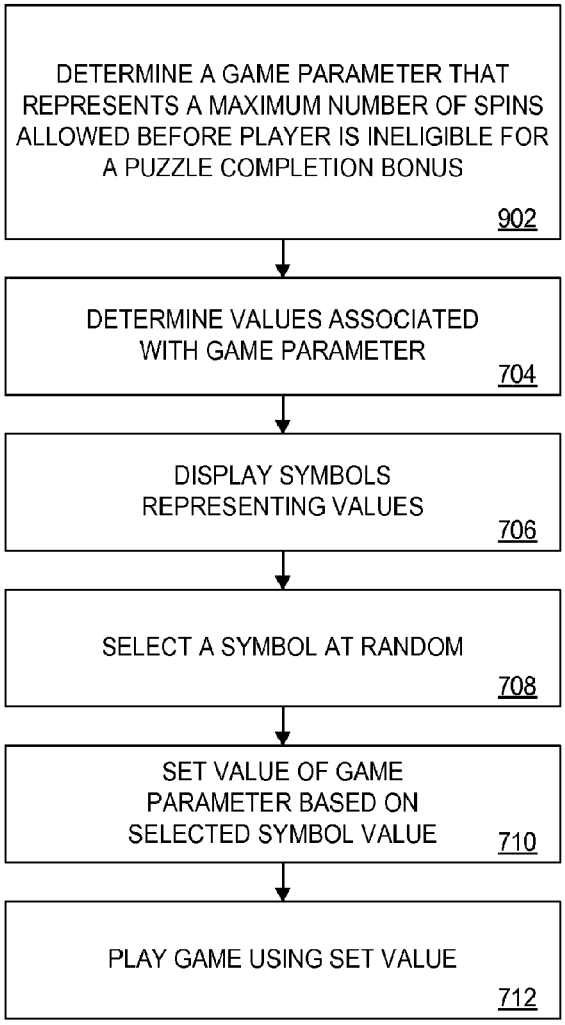
FIG. 9 is a flow chart illustrating an example process according to some embodiments of the present invention.
Figure 10:
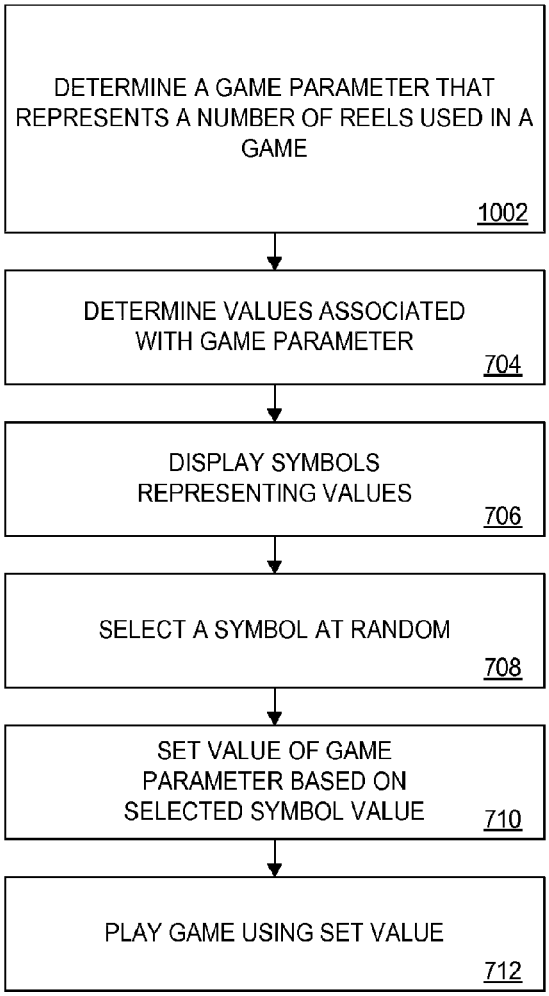
FIG. 10 is a flow chart illustrating an example process according to some embodiments of the present invention.
Figure 11:
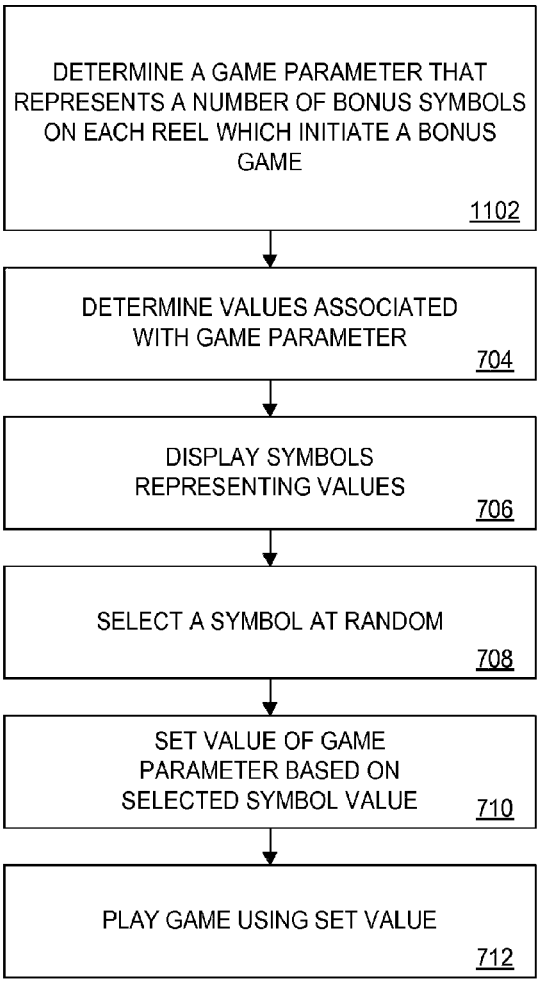
FIG. 11 is a flow chart illustrating an example process according to some embodiments of the present invention.
Figure 12:
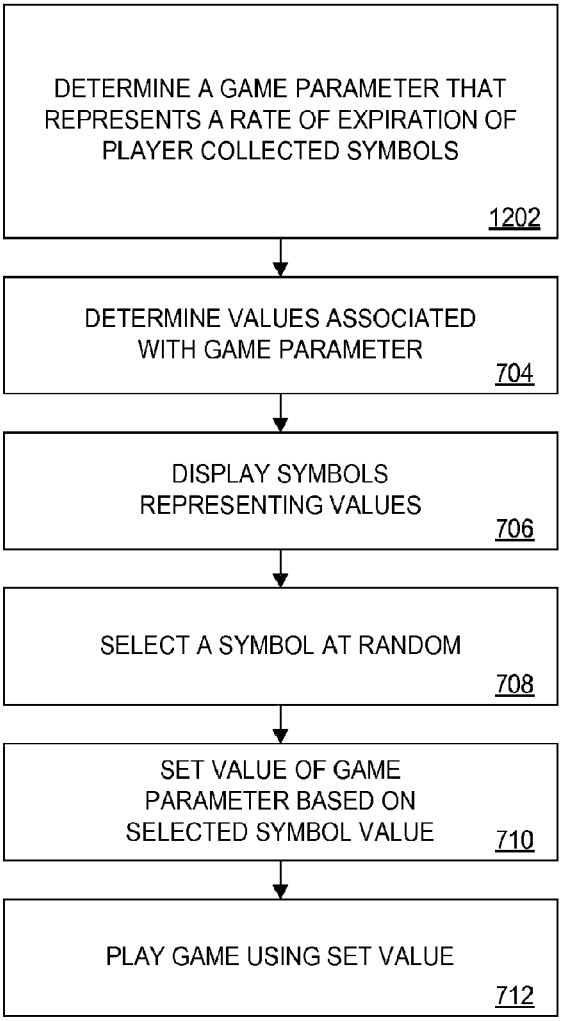
FIG. 12 is a flow chart illustrating an example process according to some embodiments of the present invention.
Figure 13:
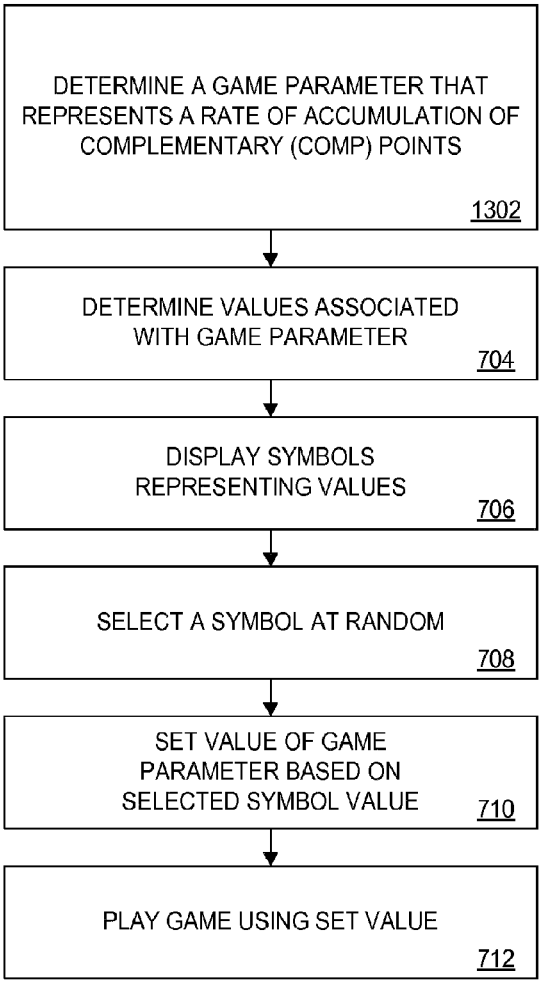
FIG. 13 is a flow chart illustrating an example process according to some embodiments of the present invention.
Figure 14:
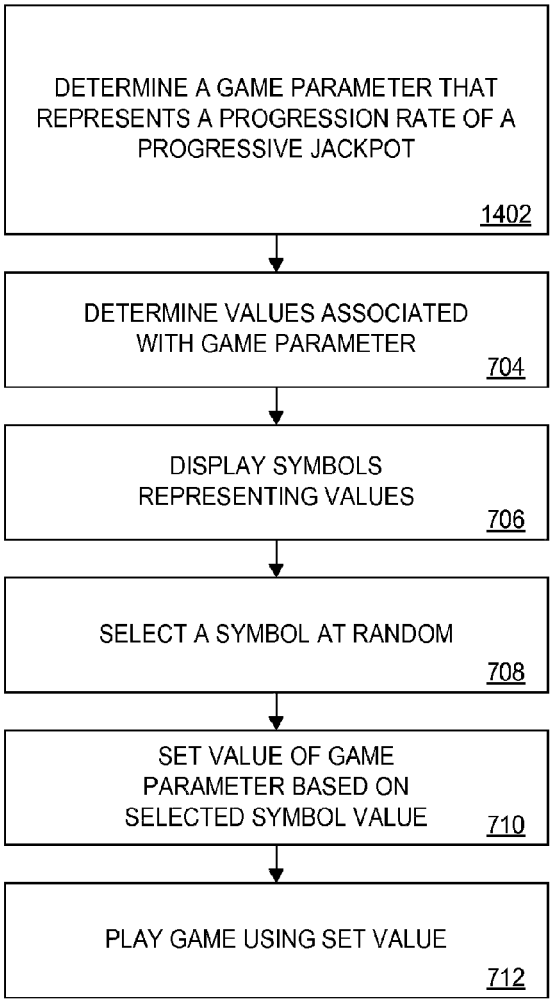
FIG. 14 is a flow chart illustrating an example process according to some embodiments of the present invention.
Figure 15:
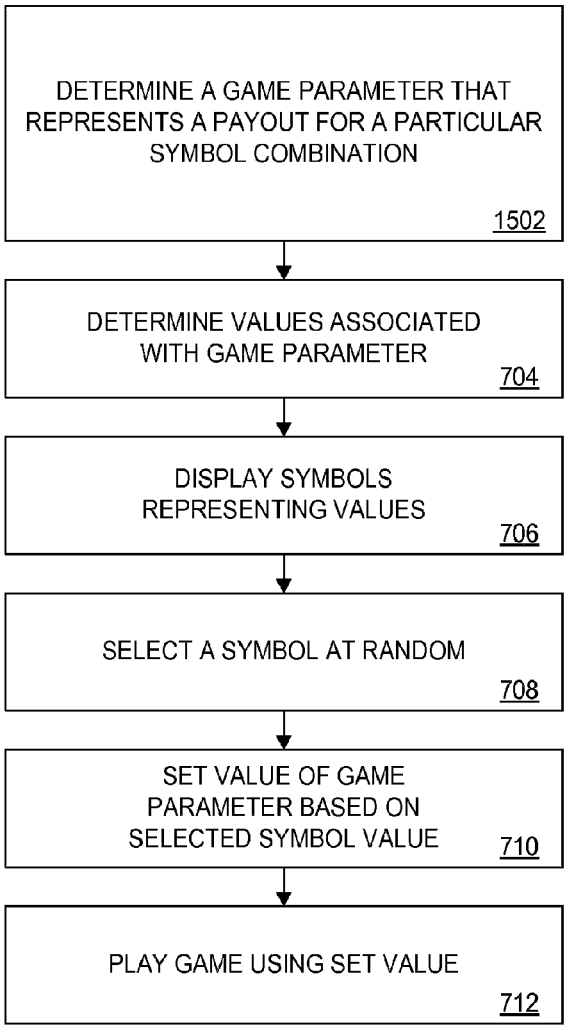
FIG. 15 is a flow chart illustrating an example process according to some embodiments of the present invention.
Figure 16:
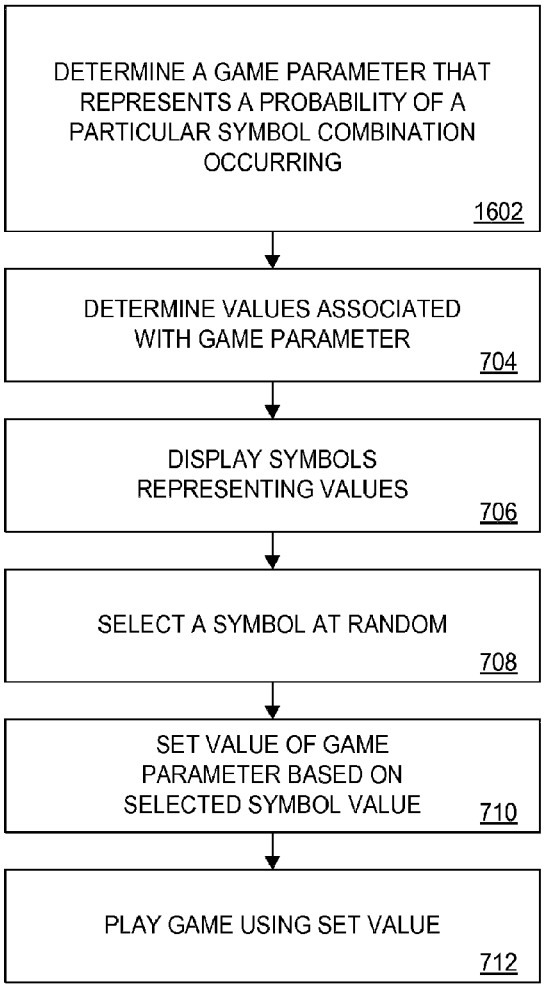
FIG. 16 is a flow chart illustrating an example process according to some embodiments of the present invention.
Figure 17:
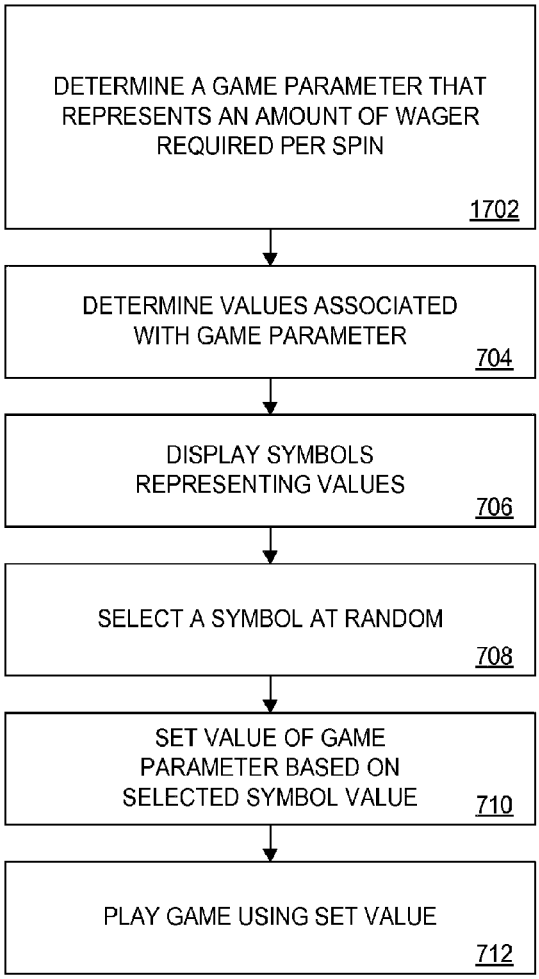
FIG. 17 is a flow chart illustrating an example process according to some embodiments of the present invention.
Figure 18:
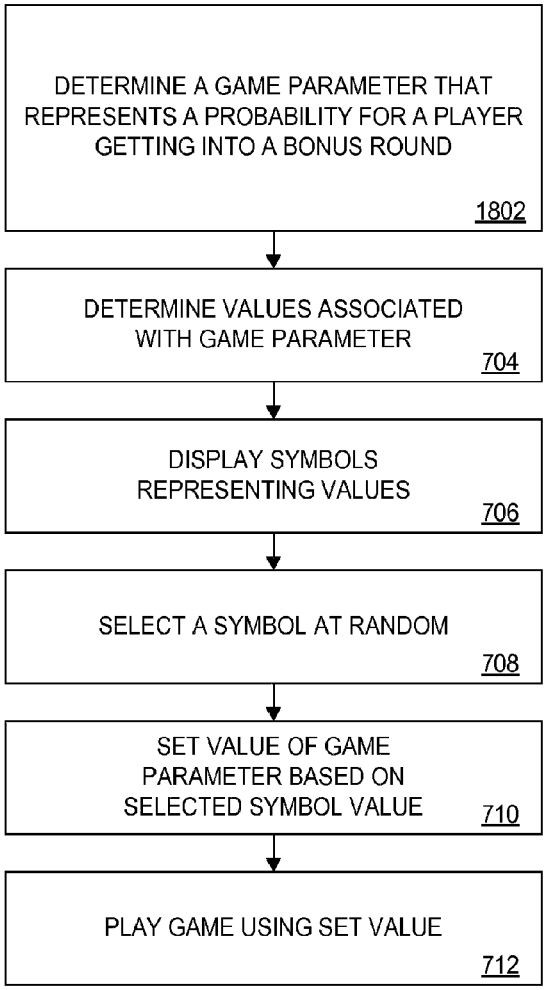
FIG. 18 is a flow chart illustrating an example process according to some embodiments of the present invention.
Figure 19:
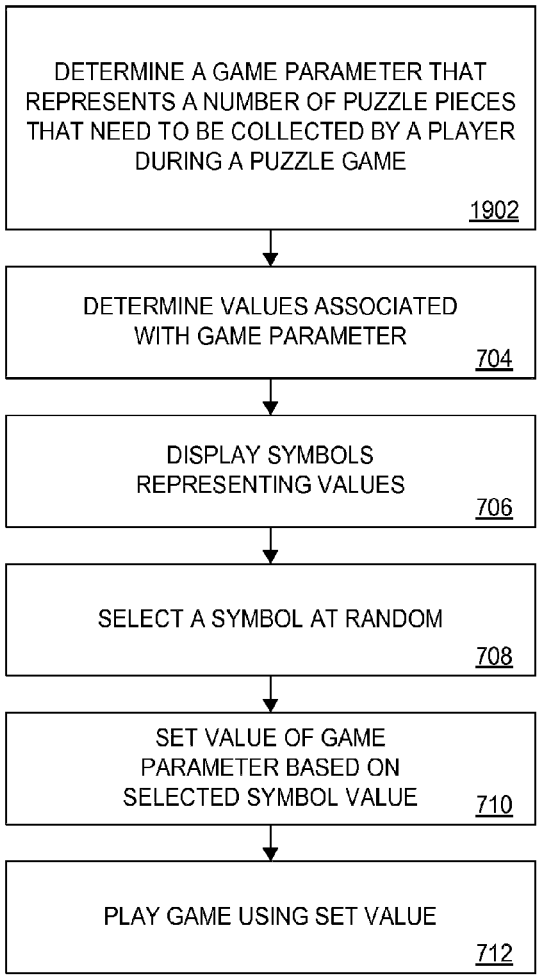
FIG. 19 is a flow chart illustrating an example process according to some embodiments of the present invention.
Figure 20:
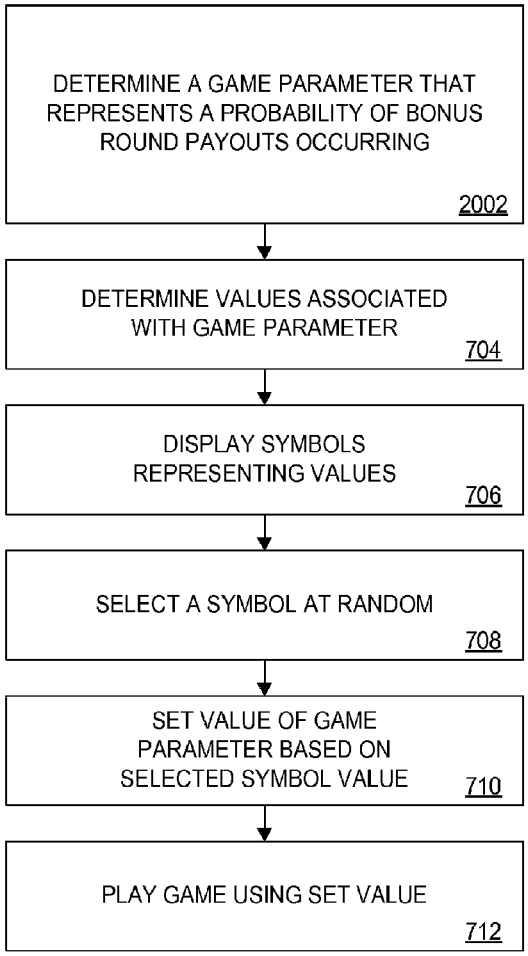
FIG. 20 is a flow chart illustrating an example process according to some embodiments of the present invention.

FIGS. 8-20 illustrate various exemplary methodology flow charts. For each figure, a different potential game parameter is set forth, although the method set forth in FIG. 7 remains substantially unchanged. In particular, FIG. 8 illustrates step 802 wherein the game parameter represents a number by which payouts will be multiplied for a given number of handle pulls. FIG. 9 illustrates step 902 wherein the game parameter represents a maximum number of spins allowed before a player is ineligible for a puzzle completion bonus. FIG. 10 illustrates step 1002 wherein the game parameter represents a number of reels used in a game. FIG. 11 illustrates step 1102 wherein the game parameter represents a number of bonus symbols on each reel which initiate a bonus game. FIG. 12 illustrates step 1202 wherein the game parameter represents a rate of expiration of player collected symbols. FIG. 13 illustrates step 1302 wherein the game parameter represents a rate of accumulation of complementary points. FIG. 14 illustrates step 1402 wherein the game parameter represents a progression rate of a progressive jackpot. FIG. 15 illustrates step 1502 wherein the game parameter represents a payout for a particular symbol combination. FIG. 16 illustrates step 1602 wherein the game parameter represents a probability of a particular symbol combination occurring. FIG. 17 illustrates step 1702 wherein the game parameter represents an amount of wager required per spin. FIG. 18 illustrates step 1802 wherein the game parameter represents a probability for a player getting into a bonus round. FIG. 19 illustrates step 1902 wherein the game parameter represents a number of puzzle pieces that need to be collected by a player during a puzzle game. FIG. 20 illustrates step 2002 wherein the game parameter represents a probability of bonus round payouts occurring.

The details of the generic example steps of FIG. 7 will now be discussed in depth.

1. Determine One or More Game Parameters

In some embodiments, the casino or gaming device 104 determines one or more game parameters. Game parameters are variables which can take on a variety of values and that may be adjusted during game play, stored in the parameter value database 322 of the gaming device 104. These parameters can serve to control one or more elements of slot machine play, such as those described below. Such parameters are especially useful for slot machine games which span a number of spins and in which multiple activities are happening both in a basic game (e.g. the spinning reels) and in secondary game elements (e.g. a secondary game screen where the player is accumulating puzzle pieces). These multi-spin games may require the player to prepay for a fixed number of handle pulls or a fixed amount of game play time. In some respects, the parameters determined may represent states of the gaming device 104.

Examples of parameters include: a number of game symbols to start a session with (e.g. number of carrots that a player is awarded as an initial starting value in a game spanning a number of spins); a multiplier value of payouts (e.g. all payouts over the next given number of spins multiplied by some value, the number of spins may also be a game parameter); a maximum number of spins allowed before player is ineligible for a puzzle completion bonus; a number of reels used in a game; a number of bonus symbols on each reel which initiate a bonus round; a rate of expiration of collected cherry symbols (e.g. a player might be paid 10 coins for each cherry accumulated over a twenty-five spin game, but the cherries gradually lose value after every handle pull—the expiration rate could be the number of credits in lost value per handle pull); a rate of accumulation of complementary (comp) points; a progression rate of a progressive jackpot; a payout for orange-orange-orange; a probability of bar-bar-bar; an amount of wager required per spin; a probability of a player getting into a bonus round; a number of puzzle pieces that need to be collected by a player during a puzzle game; a probability of bonus round payouts occurring (e.g. the portion of treasure chests selectable by the player that have a coin value); a number of whammy symbols which may reduce a player's credit balance; a number of handle pulls and/or an amount of time that a prepaid session and/or bonus game will last; and/or the like.

More than one game parameter may also be determined during this step. As an illustration of some embodiments of the present invention, the following "Garden Game" example will be referred to throughout the following example process steps. In the Garden Game (a three reel game), the player pays 20 credits for a single game which spans multiple handle pulls. His garden starts with a number of carrots, and the game includes a rabbit character that hops onto the screen to occasionally eat the carrots. The player can win coins on each spin, and the game continues until the rabbit has eaten all of the carrots. Two other game elements are included: a fox character and fence symbols. The fox can scare away the rabbit, and the fence symbols can be used to erect a full or partial fence around the garden, reducing the chance that the rabbit is able to steal one or more carrots.

A secondary screen shows a graphical image of the garden and carrots. Animated images of the rabbit and fox characters also are periodically displayed on the secondary screen. These game characters are activated by a reel symbol on the basic game occurring on a payline. For example, the first reel may have three rabbit symbols. When one of these appears on the payline, the gaming device animates the rabbit character on the secondary screen and has it steal one or more carrots. Fox symbols and fence symbols also appear on the reels and trigger their respective game elements to appear on the secondary screen. There are many possible parameters in this game, but for brevity, only the following four will be used in the illustration:

Number of carrots the player starts with

Number of rabbit symbols

Number of fox symbols

Number of fence symbols

Other possible parameters, for example, would include the number of carrots that the rabbit steals on each attempt, the probability that the rabbit is successful in a steal attempt, the number of spins during which the fox is able to scare away the rabbit, the extent of coverage provided by each fence symbol, the probability of the rabbit knocking down a fence, the number of poisoned carrots (which could kill a rabbit), the coin value for achieving an outcome of fox-fox-fox on the payline, etc.

In some embodiments, players may be permitted to select which parameters they would like to see being determined or have changed from an initial value. In some embodiments, the parameters that are to be changed from an initial value may be selected at random.

2. Determine Possible Values Associated with these Game Parameters

Possible values associated with the parameter selected in the previous step are next determined. Once the values are determined they may be stored in the parameter value database 322 and then used in future game play (for the next handle pull, the next series of handle pulls, until a particular reel symbol appears on a payline, for a given amount of time, etc.)

The following examples of parameter values correspond to the first six example parameters described in the previous step. Values may include: starting a session with 8, 10, or 12 carrots; multiplying payouts over the next ten spins by factors of 2.times., 3.times., or 4.times.; the player becomes ineligible for bonus after 25, 30, or 35 spins; the game uses 3, 4, or 5 reels; each reel contains 2, 3, or 4 bonus symbols; and Cherry symbols expire with zero value after 40, 50, or 60 seconds. Note that some of the above parameter values are expressed as total or aggregate values. For example, "starting a session with 8, 10, or 12 carrots" indicates the total number of carrots that a player will start with at the beginning of his game session.

Continuing with the Garden Game example from the previous step, it can be seen how each of the four identified game parameters would have a range of possible values:

| Parameter | Possible Values |
|---|---|
| Number of carrots the player starts with | 8, 10, 12, or 15 |
| Number of rabbit symbols | 2, 4, or 6 |
| Number of fox symbols | 2, 4, 6, or 8 |
| Number of fence symbols | 16, 20, 24, or 30 |

Alternative ways of expressing the possible values may be used in this example embodiment of the invention. In the case of the number of carrots that the player starts with, for example, the possible values could be expressed as: a range of values (e.g. from 8 to 15 carrots); a formula (e.g. double the number of fox symbols); and/or probabilistically based values (e.g. 36% chance of 8, 36% chance of 10, 18% chance of 12, 10% chance of 15)

3. Display One or More Symbols on a Reel Each Representing a Possible Value of the One or More Game Parameters Reel symbols representing possible values of the game parameters may now be displayed. These symbols could be displayed on a single reel, or spread out over a number of reels. While they could be intermingled with the regular game symbols, in the current example embodiment, the game parameter value symbols are the only ones appearing on the reels, resulting in less confusion for the player.

Before the reel symbols with possible parameter values are displayed, the gaming device 104 could provide informational messages to the player indicating why the process was occurring. For example, the player might see an introductory screen which says:

> "Let's see how many carrots you will get to start with—we'll fill the reels with carrot value symbols and spin them to see the total number of carrots you will start with. Good luck!"

In this example, the first reel could include a symbol representing 8 carrots, a second symbol representing 10 carrots, and a third symbol representing 12 carrots. Note that in this embodiment, no other symbols appear on the first reel, and no symbols appear at all on the second and third reels. That is, the entire set of reels is essentially cleared of basic game symbols, with the three game parameter value symbols then applied to the first reel.

Clearing of the reels could be accomplished in a variety of ways, and may be done in a manner that entertains the player in addition to carrying out the function of clearing the reels. During this process, all of the basic game symbols that appear on the reels are removed. For example, the cherries, plums, bells, sevens, bars, and oranges from a standard fruit machine may be cleared away to make room for the parameter value symbols. By "cleared away" it is meant that the normal game symbols are no longer visible to the player, or are clearly not active. Exemplary methods of generating the effect of clearing the reels include: digitally removing the game symbols (i.e. eliminating one or more reel stop positions from the electronic reels or turning one or more reel stop positions into blank symbols); graying out game symbols; making the symbols smaller so as to look almost insignificant (e.g. minimizing or reducing); animating the reels to make it look as though the reels with the normal symbols were being removed, replaced by a new set of reels containing possible game parameter value symbols; animating the reels to make it look like they are spinning, and then having a virtual blade appear to "scrape off" the symbols; and/or animating the reels to make it appear that they are being dipped in an acid solution which washes away the reel symbols.

Once the reels had been cleared of the normal game symbols, the symbols representing possible parameter values would be applied. As in the case of removing symbols, the applying process could be done in an entertaining manner, for example, by "dropping" the parameter value symbols from a secondary screen onto the reels and/or "dipping" the cleaned reels into a bucket containing the parameter value symbols, with some of all of the symbols sticking to the reels.

Instead of changing the reel symbols on the reels, the gaming device could "swap out" the basic set of reels and replace it with a set of reels containing parameter values. The swapping out process would be graphically represented in a way that made it clear that one set of reels was replacing another. For example, one set of reels could appear to be pushed back into the machine while the second set of reels appeared from the front of the machine to replace it.

In some embodiments, the regular reel symbols of the basic game maybe used to determine the parameter values by mapping each of the regular symbols directly to a corresponding game parameter value. For example in the Garden Game, a "BAR" symbol may represent a "carrot" game parameter with a value of three.

While the above examples may require a gaming device 104 with electronic reels, in some embodiments of the invention physical reels may be used to display the regular game symbols while a secondary screen is used to display the parameter value symbols.

It should be noted that the parameter value symbols could be generated to reflect fractions of the desired parameter values. In the example described above where the game parameter is the number of carrots to begin a session with, instead of having parameter value symbols of 8 carrots, 10 carrots, and 12 carrots an alternative arrangement could be used in which smaller carrot value symbols are spread out over all three reels in which the symbols are "added together" to generate the final parameter value. For example, the following reel symbol frequencies could be used:

$1^{st}$ reel—three "3 carrot" symbols and three "4 carrot symbols"

$2^{nd}$ reel—seven "2 carrot" symbols and two "4 carrot symbols"

$3^{rd}$ reel—five "3 carrot" symbols and four "4 carrot symbols"

After spinning this set of reels the player might receive a result of "3 carrot", "2 carrot", "4 carrot" for a total of nine carrots to begin the game with. Note that with this configuration of reel symbols, possible total parameter values include 8, 9, 10, 11, and 12 carrots (although not with equal probabilities). By varying the number of symbols associated with each symbol value, the probabilities of each possible final total value can be adjusted to fit the requirements of the game. In another embodiment, the player may spin the reels a number of times in order to determine the number of carrots to start with, with the total accumulated over a number of spins representing the new parameter value.

Note also that more than one set of parameter values could be displayed at the same time. To illustrate this example embodiment, the Garden Game example described above will be used. In this example, four parameter values need to be established: number of (1) carrots, (2) foxes, (3) rabbits, and (4) fences. In some embodiments, the player will see the reels cleared of the normal game symbols and replaced with the following parameter value symbols:

| | 15 value | 12 value | 10 value | 8 value | 6 value | 4 value | 2 value |
|---|---|---|---|---|---|---|---|
| First Reel | 2 carrot | 4 carrot | 8 carrot | 8 carrot | 0 carrot | 0 carrot | 0 carrot |
| Second Reel | 0 rabbit | 0 rabbit | 0 rabbit | 0 rabbit | 2 rabbit | 10 rabbit | 10 rabbit |
| Third Reel | 0 fox | 0 fox | 0 fox | 4 fox | 8 fox | 5 fox | 5 fox |

In the above table, the top row indicates the magnitude of the parameter value but not the identity of the corresponding parameter. The individual cells indicate both the parameter (e.g. carrot) and the number of symbols on that reel with that magnitude. For example, there are 4 carrot parameter value symbols which indicate a starting value of 12 carrots. While there are no fence symbols illustrated in the table, this parameter value could be set as double the number carrot symbols determined.

Note that in this example the total number of parameter value symbols on each reel is 22, providing a visual consistency to the player as the reels are spinning.

4. Randomly Select One or More Displayed Symbols

A random number may be generated by the random number generator 302 of the gaming device 104, and this random number may then be associated with an outcome in the parameter value database 322. For example, the random number 03459 might correspond to the result of "12 CARROTS." As discussed above, those of ordinary skill in the art will appreciate that there are many methods by which to determine a random number, such as algorithms stored in electronic memory or physical random number generators (such as a lottery blower type device).

In some embodiments, the processor 300 of the gaming device may then instruct a reel controller to spin the reels until they show a result of "12 CARROTS" on the payline of the first reel. In some embodiments, each parameter value symbol may have an equal probability of appearing on a payline, or the probabilities could be adjusted so that one or more parameter value symbols were more likely to be selected.

5. Set Value of One or More Game Parameter Based on the Randomly Selected Displayed Symbols The value of the game parameter is established according to the randomly selected displayed game parameter value symbol(s). For example, the value of the starting number of carrots for the game session may be established as 12 when a game parameter value symbol with a magnitude of 12 carrots appears on the payline.

Continuing with the Garden Game example, the payline of the reel spin might reveal an outcome of:

First Reel: 12 carrots

Second Reel: 6 rabbits

Third Reel: 2 foxes

The number of fence symbols would be double the number of carrots, or 24 fence pieces. These values are then stored in the parameter value database 322 within the gaming device 104, and are accessible by the processor 300 of the gaming device 104.

Once the values are determined they may be displayed to the player. Continuing with the Garden Game example, the number of carrots to begin with may be represented by populating a virtual garden in a secondary screen with the starting parameter value. A numeric meter could track the status of the number of carrots, decrementing each time a carrot was taken.

F. EXAMPLE ILLUSTRATIVE EMBODIMENTS OF THE INVENTION

The following very specific additional examples are provided to illustrate particular embodiments of the present invention, particularly from the perspective of potential users of the system 100, including players and casinos.

Example 1

Initiating Spin (No. 1)

A player inserts a bill into the bill validator of a slot machine and establishes a balance of 80 credits. He chooses to play a game in which he is allocated a number of carrots which populate a virtual garden on a secondary screen. These carrots are periodically stolen by a rabbit game character, with the rabbit stealing a carrot every time a rabbit symbol appears on the payline of one of the reels. The game costs 20 credits, and the player spins until all of his carrots are stolen. After providing the 20 credits to start the session, the slot machine establishes the parameter of the number of carrots the player will start with by clearing all of the reel symbols and replacing them with carrot symbols numbered 1, 2, 3, and 4. The player spins and gets 2-4-3 for a total of nine carrots. These nine carrots electronically populate the garden screen on the secondary screen. The carrot symbols are then removed from the reels and replaced with the normal reel symbols for the game. The player pulls the handle and the game plays normally.

Example 2

Mid-Game Changes

In the middle of the game described in Example 1, the player gets a "scramble" symbol on the payline of one of the reels causing the reels to be immediately blanked out and repopulated with new symbols which will be used to determine new parameter values. The first reel contains only fox symbols, with values overlaid onto each fox ranging from 1 to 5. The next reel contains fence symbols with values from 10 to 20. The final reel has rabbit symbols, ranging from 1 to 3. The player presses the spin button and gets a result across the payline of fox 3, fence 8, rabbit 3. The slot machine then wipes out these fox, fence, and rabbit symbols and replaces them with the normal game symbols, except that the number of fox, fence, and rabbit symbols is dictated by the number obtained after the scramble symbol, i.e. the reels contain 3 fox symbols, 8 fence symbols, and 3 rabbit symbols.

Example 3

Concluding Parameters

The player pays 20 credits for a game in which the object is to collect fruit over a period of 20 spins, with a payout at the end of the game based on the value of fruit collected. The collected fruit symbols change value every handle pull, ripening or deteriorating according to a fixed schedule associated with each fruit. After the last spin, the player has accumulated 36 pieces of fruit. But before the value of each fruit is totaled and provided to the player, a final spin is conducted to determine a multiplier value. All of the regular game symbols from each reel are deleted, and the first reel is repopulated with multiplier symbols ranging from 2.times. to 10.times. The player presses a button and this single reel is spun, resulting in a multiplier value of 7.times. showing up on the payline. This multiplier value is then applied to the final aggregated value of the fruit collected by the player to determine a final payout value.

Example 4

Initiating Spin (No. 2)

A player pays 20 credits for a Monopoly-themed game in which the object is to earn rents from collected properties and avoid paying rents on the properties held by computer opponents. To begin the game, the gaming device randomly distributes the properties in groups. For example, all three red colored properties would be distributed together as a bundle rather than individually. The distribution process involves a spinner device which has a location for each Monopoly color group. The device is spun once for each player, and the color it lands on is the color group that the player now controls. The spinner continues to spin, allocating color groups to the player and to one or more computer opponents. Once the properties are distributed, the primary game begins in which the player's game token moves around an electronic representation of a Monopoly board. At several points during the game houses may be randomly distributed to the player and his computer opponent, using a similar spinner.

G. OTHER EMBODIMENTS

In some embodiments, instead of displaying the parameter values on the reels as reel symbols, some or all of the parameter values could be displayed on secondary screens—selected at random by the slot machine. For example, in the Garden Game discussed above, the gaming device 104 may determine the number of carrot symbols to start with through the use of a "spinner" displayed on a secondary screen. The spinner might have ten possible outcomes, ranging from 3 carrots to 15 carrots. The outcome randomly selected is the number of credits that the player starts with. While the process of initiating this parameter setting spin could come from the processor of the gaming device, the player himself might be allowed to initiate the spin—perhaps by pressing a button or touching a location on the secondary screen. In another embodiment, parameter values are displayed on one or more peripheral devices associated with the gaming device.

In some embodiments, instead of a random selection of the parameter values by the gaming device, a punchboard-like embodiment could be used in which a grid of locations is presented to the player. Applied in the context of the above-described Garden Game, the grid could contain symbols with parameter values, from which the player selected four locations. Each of the four locations would reveal a parameter value. If the player selects more than one of a particular parameter before all four parameter values have been determined, the player may be awarded the highest value chosen, or could be awarded the sum of both selections.

In some embodiments, the magnitude of the parameter value symbol could be determined after the parameter value symbol appeared on the payline. In such embodiments, a fox symbol might show up on the payline. A pair of dice are then animated on top of the parameter value symbol and they roll to form a number from 2 to 12, the resulting number being the final parameter value.

In some embodiments, parameter values could be established: before every spin; at the beginning of each game; at the conclusion of each game; upon request by the player; upon the occurrence of a random triggering event; at a predetermined time (e.g. every 100 spins); when a particular payout occurs; when the player inserts his player tracking card; when the player inserts a bill into the bill validator; and/or when the credit balance of the player reaches a predetermined level.

In some embodiments, the process of changing one or more game parameters may be triggered by actions of the player. Such actions might include: a player losing more than a given number of spins in a row; a player getting a given number of "close calls" in a row (e.g. two of the reel symbols match); a player losing more than a given number of dollars in a given number of minutes and/or a given number of handle pulls; a player depositing more than a given number of dollars into the machine; a player speeding up play; and/or a player slowing down play.

In some embodiments, the parameter selected in a game could be determined not by the magnitude of the parameter value chosen, but by the amount by which that parameter value grew over time. For example, in the case of the Garden Game the number of carrots to begin with may start at three and then increase by one for every handle pull of the gaming device—stopping when the player gets a fox symbol. Once the fox symbol appears, whatever level the number of carrots has risen to becomes the parameter value for the number of carrots to start with.

Although the Garden Game example describes an embodiment with a parameter value of the number of carrots to start with, other embodiments are possible in which the parameter value is not a starting value but a target ending value. For example, the player may prepay for a game and have the ability to keep pulling the handle at no additional cost as long as his balance of carrots did not build up to the parameter ending value determined at the beginning of the game. For example, if the parameter ending value were determined to be 12, the player might pull the handle until he had accumulated 12 carrot symbols from the reels.

Other embodiments of the present invention apply to table games such as blackjack, roulette, or craps. In the game of blackjack, for example, parameter values might include the number of decks to be used, whether or not the dealer stands on a soft 17, the amount of bonus paid for achieving a hand of 21 comprised of the 6, 7, and 8 of one suit, etc. In roulette, parameter values could include the number of chips that could be purchased for a $20 buy-in or the payout for hitting a single number. In each of these table game embodiments, peripheral devices could be attached to the table which allow the dealer or players to electronically or physically determine one or more parameter values.

In video poker embodiments, game parameters might include the number of cards in the deck, the payout for achieving a royal flush, a number of wildcards, then number of cards in a hand, whether or not any cards may be drawn (e.g. stud versus draw poker); and/or the identity of a bonus card which, when dealt, automatically doubles the payout earned for that hand.

In some embodiments, parameter values are used to configure or define game characters, their characteristics, and/or their behaviors. For example, the ability of a game character to alter one or more outcomes of the game or the probability that such a game character appears in the game are parameters that may be set using the present invention. Parameters could also be used to configure objects used by a player throughout a game, such as the engine size of a race car used by the player in a race conducted during a bonus round.

In some embodiments, parameter values "won" by a player may be stored for use during future gaming sessions. In some embodiments for example, a player may be provided with a cashless gaming receipt that includes an indication of the values of one or more game parameters that were determined for him during his gaming session. In some embodiments, a player's game parameters and/or values may be stored by a casino in a player database in association with a player identification number or on a player tracking card. For example, during a play session, a player may receive a random parameter determination outcome that entitles him to "one hour of play with half-priced wagers." However, after enjoying the discounted gaming for only fifteen minutes, the player realizes that he is late for an appointment and must leave. In some embodiments of the invention, the player may be presented with a choice to either cash out and forfeit his remaining forty-five minutes of discounted gaming or accept a cashless gaming receipt that indicates that if the player returns to the casino and applies the monetary face value on the cashless gaming receipt to future play, he will receive his unused forty-five minutes of play with half-priced wagers. In this manner, the player may preserve the "equity" he has in parameters and/or values he earns with the present invention. In some embodiments, a player may be provided with an opportunity to pay a fee to save or extend his parameter values for future use. In some embodiments, a player may pay a fee to increase or modify a game parameter value.

Figure 21:
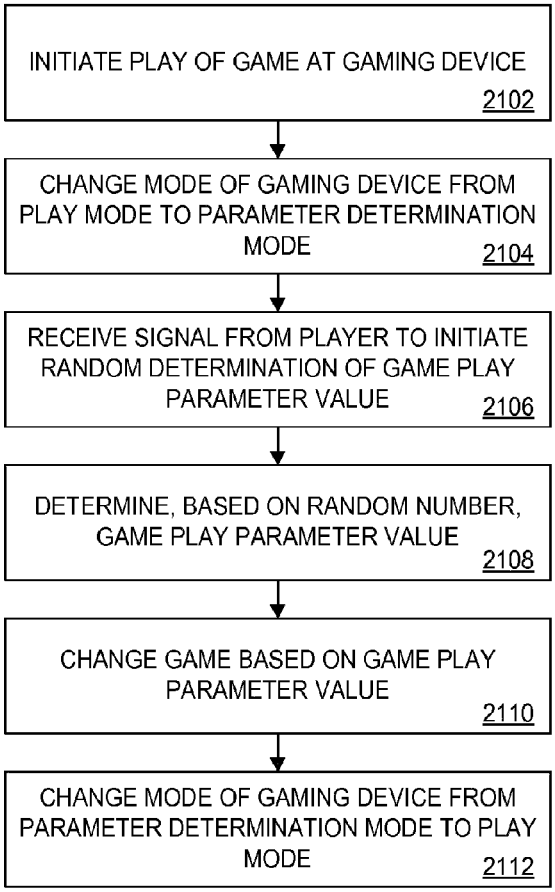
FIG. 21 is a flow chart illustrating an example process according to some embodiments of the present invention.
Figure 22:
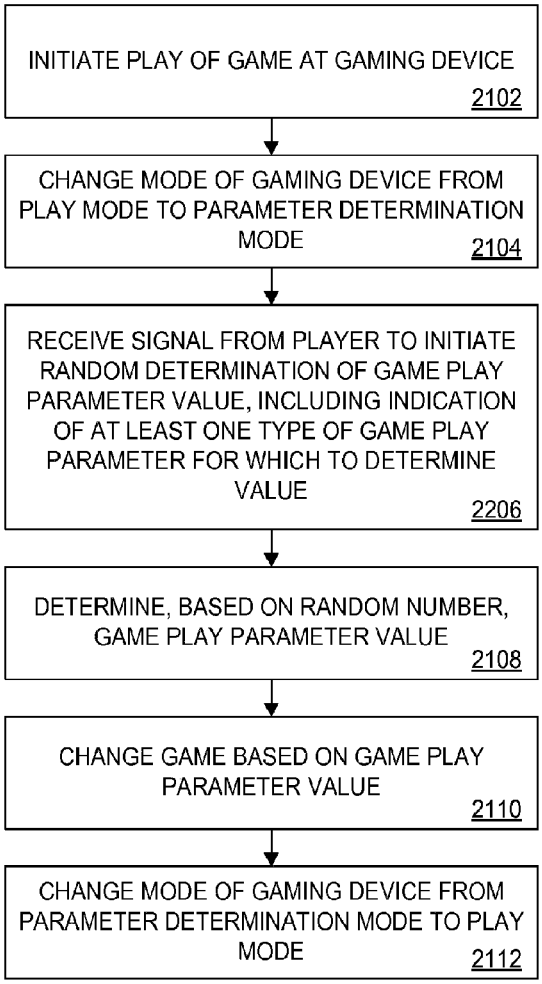
FIG. 22 is a flow chart illustrating an example process according to some embodiments of the present invention.
Figure 23:
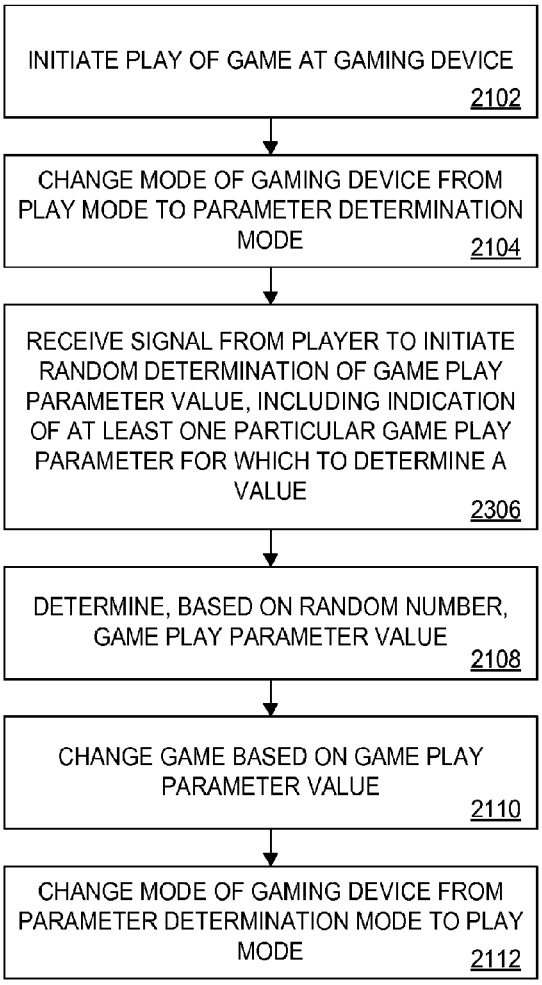
FIG. 23 is a flow chart illustrating an example process according to some embodiments of the present invention.

FIGS. 21-23 illustrate still other exemplary methodologies. FIG. 21 in particular sets forth the generic version of the methodology wherein the method comprises initiating play of game at a gaming device (step 2102); changing the mode of the gaming device from a play mode to a parameter determination mode (step 2104); receiving a signal from a player to initiate the random determination of the game play parameter value (step 2106); determining, based on the generated random number, the game play parameter value (step 2108); changing the game based on the game play parameter value (step 2110); and changing the mode of the gaming device from the parameter determination mode back to the play mode (step 2112).

FIGS. 22-23 illustrate specific exemplary embodiments wherein the nature of the signal received from the player is varied. In particular, FIG. 22 illustrates step 2206 that the signal includes an indication of at least one type of game play parameter for which a value is to be determined. FIG. 23 illustrates step 2306 that the signal includes an indication of at least one particular game play parameter for which a value is to be determined.

Figure 24:
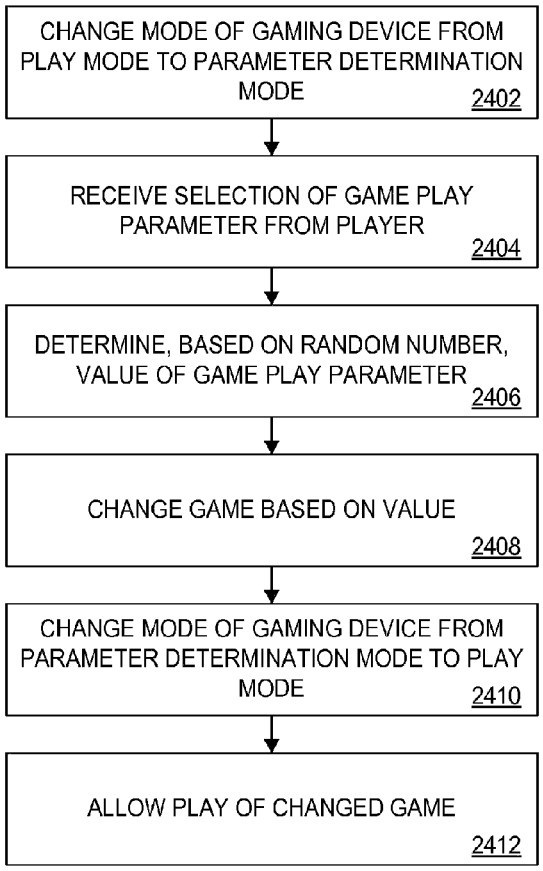
FIG. 24 is a flow chart illustrating an example process according to some embodiments of the present invention.

FIG. 24 illustrates an alternate method wherein the method changes the mode of the gaming device from a play mode to a parameter determination mode (step 2402); receives a selection of a game play parameter from the player (step 2404); determines, based on a random number, a value for the game play parameter (step 2406); changes the game based on the value (step 2408); changes the mode of the gaming device from a parameter determination mode to a play mode (step 2410); and allows play of the changed game (step 2412).

Figure 25:
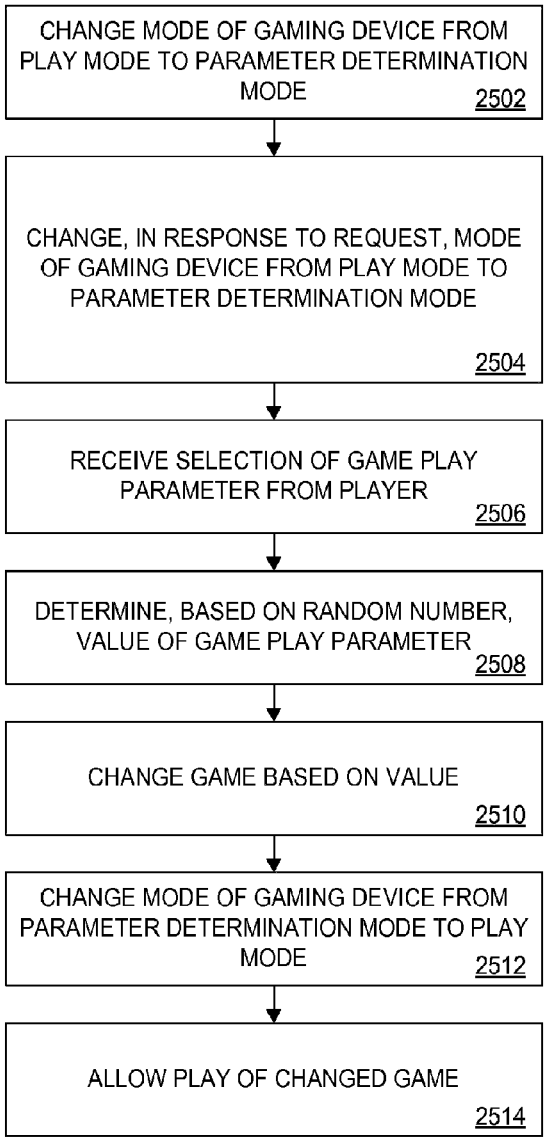
FIG. 25 is a flow chart illustrating an example process according to some embodiments of the present invention.

FIG. 25 illustrates an alternate method wherein the method changes the mode of the gaming device from a play mode to a parameter determination mode (step 2502); changes, in response to a request, the mode of the gaming device from the play mode to the parameter determination mode (step 2504); receives selection of a game play parameter from the player (step 2506); determines based on a random number, a value of the game play parameter (step 2508); changes the game based on the value (step 2510); changes the mode of the gaming device from the parameter determination mode to the play mode (step 2512); and allows play of the changed game (step 2514).

Figure 26:
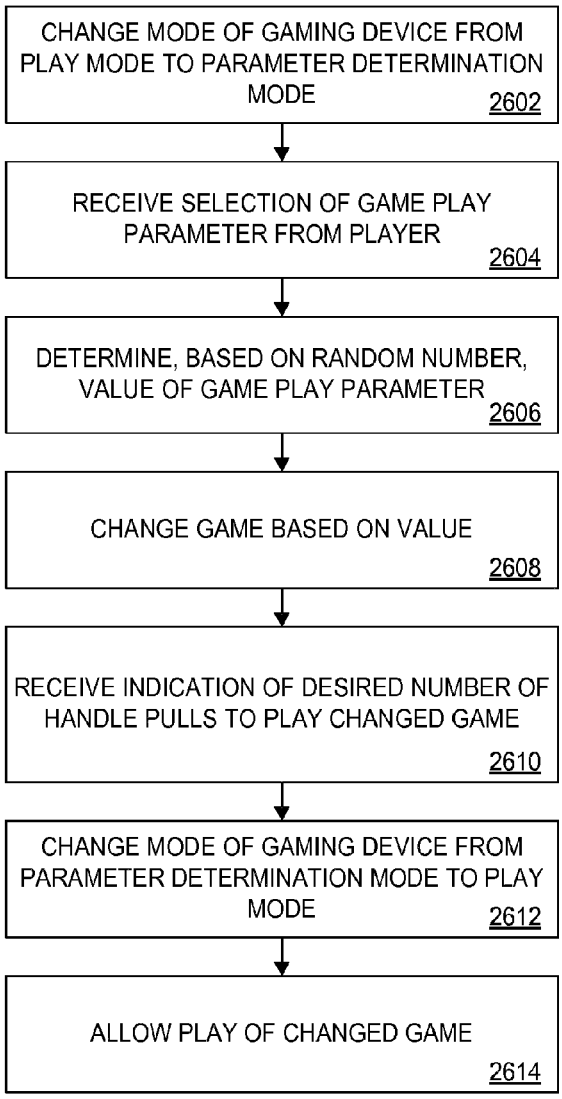
FIG. 26 is a flow chart illustrating an example process according to some embodiments of the present invention.

FIG. 26 illustrates an alternate method wherein the method changes the mode of the gaming device from a play mode to a parameter determination mode (step 2602); receives a selection of a game play parameter from a player (step 2604); determines, based on a random number, a value for the game play parameter (step 2606); changes the game based on the value (step 2608); receives an indication of a desired number of handle pulls to play the changed game (step 2610); changes the mode of the gaming device from the parameter determination mode to the play mode (step 2612); and allows play of the changed game (step 2614).

Figure 27:
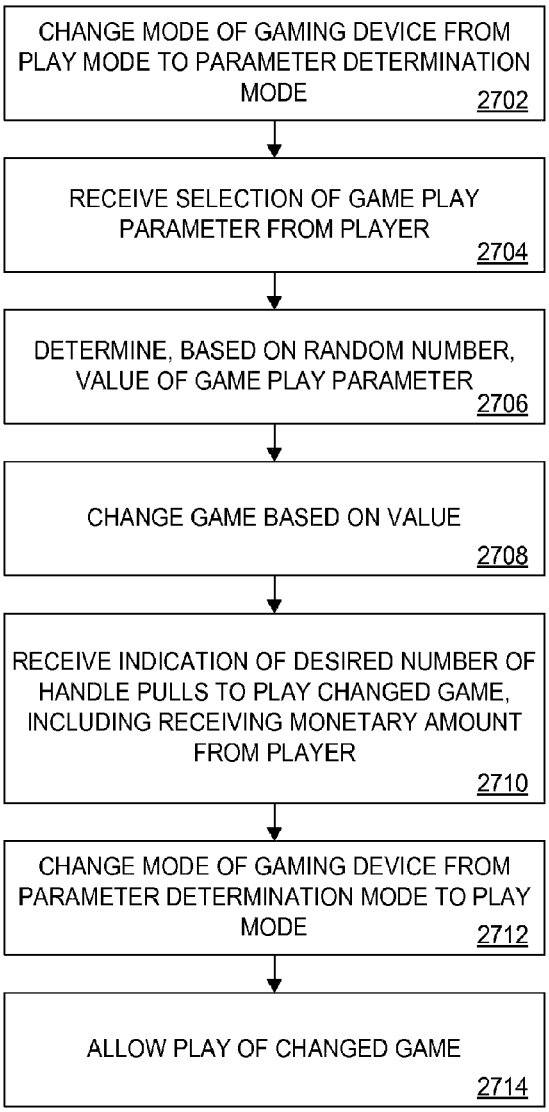
FIG. 27 is a flow chart illustrating an example process according to some embodiments of the present invention.

FIG. 27 illustrates an alternate method wherein the method changes the mode of the gaming device from a play mode to a parameter determination mode (step 2702); receives a selection of a game play parameter from a player (step 2704); determines, based on a random number, a value for the game play parameter (step 2706); changes the game based on the value (step 2708); receives an indication of a desired number of handle pulls to play the changed game and receives a monetary amount from the player (step 2710); changes the mode of the gaming device from the parameter determination mode to the play mode (step 2712); and allows play of the changed game (step 2714).

Figure 28:
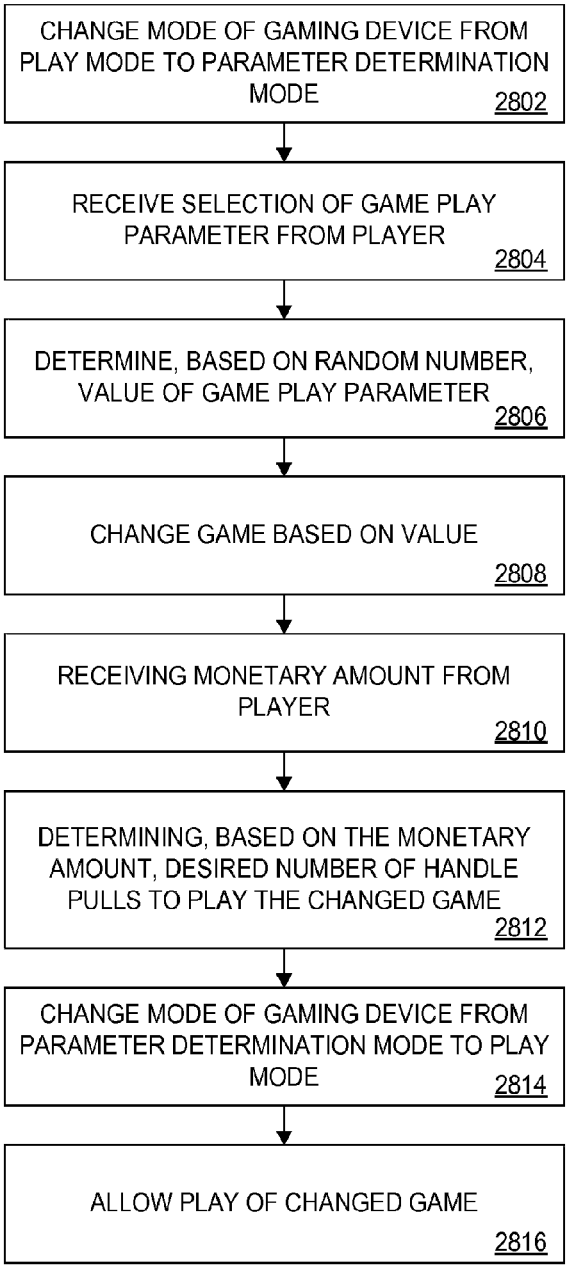
FIG. 28 is a flow chart illustrating an example process according to some embodiments of the present invention.

FIG. 28 illustrates an alternate method wherein the method changes the mode of the gaming device from a play mode to a parameter determination mode (step 2802); receives a selection of a game play parameter from a player (step 2804); determines, based on a random number, a value of the game play parameter (step 2806); changes the game based on the value (step 2808); receives a monetary amount from the player (step 2810); determines, based on the monetary amount, a desired number of handle pulls to play the changed game (step 2812); change the mode of the gaming device from a parameter determination mode to a play mode (step 2814); and allows play of the changed game (step 2816).

Figure 29:
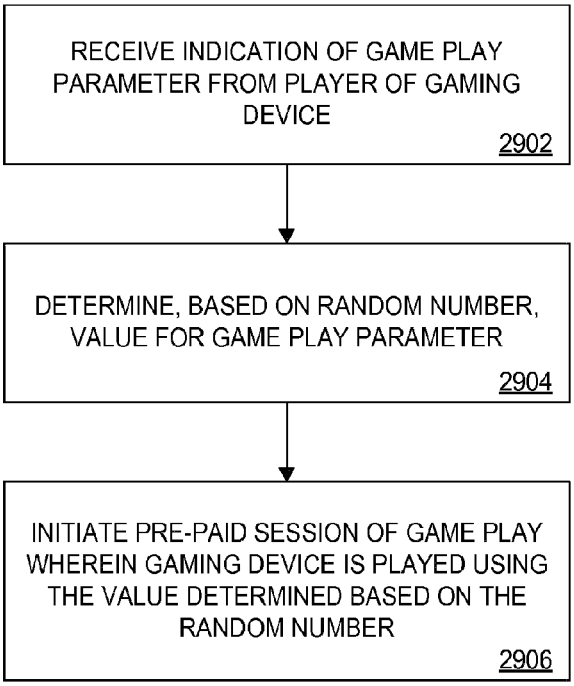
FIG. 29 is a flow chart illustrating an example process according to some embodiments of the present invention.

FIG. 29 illustrates an alternate method in which the method receives an indication of a game play parameter from a player of a gaming device (step 2902); determines based on a random number, a value for the game play parameter (step 2904); and initiates a pre-paid session of game play wherein the gaming device is used using the value determined based on the random number (step 2906).

H. CONCLUSION

It is clear from the foregoing discussion that the disclosed systems and methods to facilitate setting game parameters represents an improvement in the art of gaming. While the method and apparatus of the present invention has been described in terms of its presently preferred and alternate embodiments, those skilled in the art will recognize that the present invention may be practiced with modification and alteration within the spirit and scope of the appended claims. The specifications and drawings are, accordingly, to be regarded in an illustrative rather than a restrictive sense.

Further, even though only certain embodiments have been described in detail, those having ordinary skill in the art will certainly appreciate and understand that many modifications, changes, and enhancements are possible without departing from the teachings thereof. All such modifications are intended to be encompassed within the following claims.

In some embodiments, the computer 202 may not be necessary and/or preferred. For example, the present invention may, in one or more embodiments, be practiced on a standalone gaming device 204, one or more gaming devices 204, 206, 208 in communication with one or more peripheral devices 210, 212, 214, one or more gaming devices 204, 206, 208 in communication with a peripheral device server 216, one or more peripheral devices 210, 212, 214 in communication with a peripheral device server 216, and/or a gaming device 208 in communication only with one or more other gaming devices 204, 206. In such embodiments, any functions described as performed by the computer 202 or data described as stored in a memory of the computer 202 may instead be performed by or stored on one or more gaming devices 204, 206, 208, one or more peripheral devices 210, 212, 214, and/or peripheral device server 216.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

at least one input device;

at least one display device;

at least one processor; and at least one memory device which stores a plurality of instructions which when executed by the at least one processor for each play of a game, cause the at least one processor to operate with the at least one input device and the at least one display device to, prior to any random determinations associated with the play of the game:

(a) determine a game parameter, the determined game parameter serving to control at least one element of the game such that it affects a manner in which a play of the game will be conducted, (b) determine a range of values associated with the determined game parameter, (c) display at least one of a plurality of symbols on a reel, each symbol representing a potential value within the range of values associated with the determined game parameter, (d) randomly select at least one of the symbols, (e) set an actual value of the determined game parameter based on the randomly selected symbol, and (f) control the at least one element of the game using the actual value such that the manner in which the play of the game is conducted subsequent to the setting of the actual value is affected by the actual value.

2. The gaming system of claim 1, wherein when executed by the at least one processor, the plurality of instructions cause the at least one processor to initiate the play of the game using the actual value of the determined game parameter.

3. The gaming system of claim 1, wherein when executed by the at least one processor, the plurality of instructions cause the at least one processor to continue the play of the game using the actual value of the determined game parameter.

4. The gaming system of claim 1, wherein when executed by the at least one processor, the plurality of instructions cause the at least one processor to end the play of the game using the actual value of the determined game parameter.

5. The gaming system of claim 1, wherein the determined game parameter represents at least one selected from the group consisting of: a number of game symbols with which to start a session, a number by which payouts will be multiplied for a designated number of plays of the game, a maximum number of spins allowed before a player is ineligible for a puzzle completion bonus, a number of reels used in the play of the game, a number of bonus symbols on each reel which initiate a bonus game, a rate of expiration of player collected symbols, a rate of accumulation of complementary points, a progression rate of a progressive jackpot, a payout for a particular symbol combination, a probability of a designated symbol combination occurring, an amount of wager required per play of the game, a probability of the player getting into a bonus round, a number of puzzle pieces that need to be collected by the player during a puzzle game, and a probability of at least one bonus round payout occurring.

6. The gaming system of claim 1, wherein the game parameter serves to control the at least one element of the game such that it affects a manner in which rewards are awarded for the play of the game.

7. The gaming system of claim 1, wherein when executed by the at least one processor, the plurality of instructions cause the at least one processor to repeat (a) to (f) for a plurality of game parameters.

8. The gaming system of claim 1, wherein when executed by the at least one processor, the plurality of instructions cause the at least one processor to enable a player to select the game parameter.

9. The gaming system of claim 1, wherein when executed by the at least one processor, the plurality of instructions cause the at least one processor to determine the game parameter based on at least one selected from the group consisting of: at least one action by a player, at least one event occurring in association with at least one play of the game, and an accumulation of a designated quantity of events occurring in association with at least one play of the game.

10. The gaming system of claim 1, wherein when executed by the at least one processor, the plurality of instructions cause the at least one processor to store the set actual value of the determined game parameter in association with a player identification number.

11. A gaming system comprising:
at least one input device;
at least one display device; and
at least one processor;
at least one memory device which stores a plurality of instructions which when executed by the at least one processor for each play of a game, cause the at least one processor to operate with the at least one input device and the at least one display device to:
(a) prior to any random determinations associated with a play of the game:
(i) determine a game parameter,
(ii) determine a range of different values associated with the determined game parameter,
(iii) randomly select at least one of the different values, and
(iv) set an actual value of the determined game parameter based on the at least one randomly selected value, and
(b) after setting the actual value of the game parameter for the play of the game:
(i) determine an outcome, said outcome being determined:
(A) at least in part based on at least one random determination which occurs after the actual value of the determined game parameter is set, and
(B) at least in part based on the set actual value of the determined game parameter,
(ii) display said determined outcome,
(iii) thereafter, determine any award associated with the determined outcome, and
(iv) display to a player any determined award associated with the determined outcome.

12. The gaming system of claim 11, wherein the determined game parameter represents at least one selected from the group consisting of:
a number of game symbols with which to start the game,
a number by which any payouts will be multiplied for the play of the game,
a maximum number of spins of the reels displayed before the player is ineligible for a puzzle completion bonus,
a number of said reels used in the play of a reel game,
a number of bonus symbols on each of the reels which initiate a bonus game,
a rate of expiration of player collected symbols,
a rate of accumulation of complementary points,
a progression rate of a progressive jackpot,
a payout for a particular symbol combination,
a probability of a particular symbol combination occurring,
an amount of wager required per spin of the reels,
a probability of the player participating in a bonus round,
a number of puzzle pieces that need to be collected by the player during
a puzzle game, and
a probability of any bonus round payouts occurring.

13. The gaming system of claim 11, wherein when executed by the at least one processor, the plurality of instructions cause the at least one processor to repeat (a) for a plurality of game parameters.

14. The gaming system of claim 11, wherein when executed by the at least one processor, the plurality of instructions cause the at least one processor to enable the player to select the determined game parameter.

15. The gaming system of claim 11, wherein when executed by the at least one processor, the plurality of instructions cause the at least one processor to determine the game parameter based on at least one selected from the group consisting of: at least one action by the player, at least one event occurring in association with at least one play of the game, and an accumulation of a designated quantity of events occurring in association with at least one play of the game.

16. The gaming system of claim 11, wherein when executed by the at least one processor, the plurality of instructions cause the at least one processor to store the set actual value of the determined game parameter in association with a player identification number.

17. A method of operating a gaming system for each play of a game, said method comprising:
(a) prior to any random determinations associated with a play of the game:
(i) causing at least one processor to execute a plurality of instructions to determine a game parameter,
(ii) causing the at least one processor to execute the plurality of instructions to determine a range of different values associated with the game parameter,
(iii) causing the at least one processor to execute the plurality of instructions to randomly select at least one of the different values, and
(iv) causing the at least one processor to execute the plurality of instructions to set an actual value of the game parameter based on the at least one randomly selected value, and
(b) after setting the actual value of the game parameter for the play of the game:
(i) causing the at least one processor to execute the plurality of instructions to determine an outcome, said outcome being determined:
(A) at least in part based on at least one random determination which occurs after the actual value of the game parameter is set, and
(B) at least in part based on the set actual value of the game parameter,
(ii) causing at least one display device to display said determined outcome,
(iii) thereafter, causing the at least one processor to execute the plurality of instructions to determine any award associated with the determined outcome, and
(iv) causing the at least one display device to display to a player any determined award associated with the determined outcome.

18. The method of claim 17, wherein the game parameter represents at least one selected from the group consisting of:

a number of game symbols with which to start the game, a number by which any payouts will be multiplied for the play of the game, a maximum number of spins of the reels displayed before the player is ineligible for a puzzle completion bonus, a number of said reels used in the play of a reel game, a number of bonus symbols on each of the reels which initiate a bonus game, a rate of expiration of player collected symbols, a rate of accumulation of complementary points, a progression rate of a progressive jackpot, a payout for a particular symbol combination, a probability of a particular symbol combination occurring, an amount of wager required per spin of the reels, a probability of the player participating in a bonus round, a number of puzzle pieces that need to be collected by the player during a puzzle game, and a probability of any bonus round payouts occurring.

19. The method of claim 17, which includes causing the at least one processor to execute the plurality of instructions to repeat (a) for a plurality of game parameters.

20. The method of claim 17, which includes enabling the player to select the determined game parameter.

21. The method of claim 17, which includes causing the at least one processor to execute the plurality of instructions to determine the game parameter based on at least one selected from the group consisting of: at least one action by the player, at least one event occurring in association with at least one play of the game, and an accumulation of a designated quantity of events occurring in association with at least one play of the game.

22. The method of claim 17, which includes causing the at least one processor to execute the plurality of instructions to store the set actual value of the determined game parameter in association with a player identification number.

23. The method of claim 17, which is operated via a data network.

24. The method of claim 23, wherein the data network is an internet.

* * * * *

UNITED STATES PATENT AND TRADEMARK OFFICE

CERTIFICATE OF CORRECTION

PATENT NO. : 8,353,756 B2
APPLICATION NO. : 13/299015
DATED : January 15, 2013
INVENTOR(S) : Jay S. Walker et al.

It is certified that error appears in the above-identified patent and that said Letters Patent is hereby corrected as shown below:

IN THE CLAIMS

In Claim 1, Column 28, Line 19, replace “a play” with --the play--.
In Claim 11, Column 29, Line 24, delete “and”.
In Claim 11, Column 29, Line 25, after “processor;” insert --and--.
In Claim 11, Column 29, Line 31, replace “a” with --the--.
In Claim 12, Column 29, Line 62, delete “of the reels”.
In Claim 12, Column 29, Line 64, delete “said” and replace “a reel” with --the--.
In Claim 17, Column 30, Line 36, replace “a” with --the--.
In Claim 18, Column 31, Line 6, delete “of the reels”.
In Claim 18, Column 31, Line 8, delete “said” and replace “a reel” with --the--.

Signed and Sealed this
Twenty-sixth Day of November, 2013

Margaret A. Focarino

Margaret A. Focarino
*Commissioner for Patents of the United States Patent and Trademark Office*